US007762967B2

(12) United States Patent
Warwick et al.

(10) Patent No.: US 7,762,967 B2
(45) Date of Patent: Jul. 27, 2010

(54) CHEST COMPRESSION APPARATUS

(75) Inventors: Warren J. Warwick, Minneapolis, MN (US); Leland G. Hansen, St. Paul, MN (US); Mario Nozzarella, St. Paul, MN (US)

(73) Assignee: Respiratory Technologies, Inc., St. Paul, MN (US)

( * ) Notice: Subject to any disclaimer, the term of this patent is extended or adjusted under 35 U.S.C. 154(b) by 912 days.

(21) Appl. No.: 11/520,846

(22) Filed: Sep. 12, 2006

(65) Prior Publication Data

US 2007/0093731 A1 Apr. 26, 2007

Related U.S. Application Data

(63) Continuation-in-part of application No. 11/204,547, filed on Aug. 15, 2005, now Pat. No. 7,597,670, which is a continuation-in-part of application No. 10/038,208, filed on Jan. 2, 2002, now Pat. No. 6,958,046, which is a continuation of application No. PCT/US00/18037, filed on Jun. 29, 2000.

(60) Provisional application No. 60/716,404, filed on Sep. 12, 2005, provisional application No. 60/142,112, filed on Jul. 2, 1999.

(51) Int. Cl.

| | |
|---|---|
| ***A61H 7/00*** | (2006.01) |
| ***A61H 19/00*** | (2006.01) |
| ***A61H 31/00*** | (2006.01) |
| ***A61H 31/02*** | (2006.01) |

(52) U.S. Cl. ..... 601/152; 601/151; 601/44

(58) Field of Classification Search ..... 601/41–44, 601/148–152; 602/12; 606/202; 128/205.24
See application file for complete search history.

(56) References Cited

U.S. PATENT DOCUMENTS

| | | | |
|---|---|---|---|
| 3,462,778 | A | 8/1969 | Whitney |
| 4,135,500 | A | 1/1979 | Gorran |
| 4,197,837 | A | 4/1980 | Tringali et al. |
| 4,311,135 | A | 1/1982 | Brueckner et al. |
| 4,519,146 | A | 5/1985 | Harrington |
| 4,838,263 | A | 6/1989 | Warwick et al. |
| 4,977,889 | A | 12/1990 | Budd |
| 5,056,505 | A | 10/1991 | Warwick et al. |
| 5,453,081 | A | 9/1995 | Hansen |

(Continued)

FOREIGN PATENT DOCUMENTS

| | | |
|---|---|---|
| WO | WO 95/32753 | 12/1995 |

OTHER PUBLICATIONS

International Preliminary Report on Patentability for PCT/US2006/034783, mailed Mar. 27, 2008.

(Continued)

*Primary Examiner*—Steven O Douglas
*Assistant Examiner*—Kristen C Matter
(74) *Attorney, Agent, or Firm*—Briggs and Morgan, P.A.

(57) ABSTRACT

A chest compression apparatus and method of use providing an air flow generator component, a pulse frequency control component having a fan blade valve for producing a wave form, a multi-port air chamber and a patient vest. A vest with a sizing feature is also disclosed. The apparatus can be used to apply sharp compression pulses to the thorax via the inflatable vest worn by the patient.

26 Claims, 23 Drawing Sheets

U.S. PATENT DOCUMENTS

| | | | |
|---|---|---|---|
| 5,490,820 | A | 2/1996 | Schock et al. |
| 5,569,170 | A | 10/1996 | Hansen |
| 5,769,797 | A | 6/1998 | Van Brunt et al. |
| 5,769,800 | A | 6/1998 | Gelfand et al. |
| 5,997,488 | A | 12/1999 | Gelfand et al. |
| 6,030,353 | A | 2/2000 | Van Brunt |
| 6,036,662 | A | 3/2000 | Van Brunt et al. |
| 6,155,996 | A | 12/2000 | Van Brunt et al. |
| 6,182,658 | B1 | 2/2001 | Hayek |
| 6,210,345 | B1 | 4/2001 | Van Brunt |
| 6,254,556 | B1 | 7/2001 | Hansen et al. |
| 6,340,025 | B1 | 1/2002 | Van Brunt |
| D453,560 | S | 2/2002 | Van Brunt |
| 6,379,316 | B1 | 4/2002 | Van Brunt et al. |
| D456,591 | S | 5/2002 | Hansen |
| 6,415,791 | B1 | 7/2002 | Van Brunt |
| D461,897 | S | 8/2002 | Hansen et al. |
| 6,471,663 | B1 | 10/2002 | Van Brunt et al. |
| 6,488,641 | B2 | 12/2002 | Hansen |
| D469,876 | S | 2/2003 | Hansen et al. |
| 6,547,749 | B2 | 4/2003 | Hansen |
| D478,989 | S | 8/2003 | Hansen et al. |
| 6,605,050 | B2 | 8/2003 | Hansen |
| 6,676,614 | B1 | 1/2004 | Hansen et al. |
| 6,736,785 | B1 | 5/2004 | Van Brunt |
| 6,757,916 | B2 | 7/2004 | Mah et al. |
| 6,764,455 | B2 | 7/2004 | Van Brunt et al. |
| 6,910,479 | B1 | 6/2005 | Van Brunt |
| 6,910,483 | B2 * | 6/2005 | Daly et al. ..... 128/204.26 |
| 6,916,298 | B2 | 7/2005 | VanBrunt et al. |
| 6,958,046 | B2 | 10/2005 | Warwick et al. |
| 2002/0014235 | A1 | 2/2002 | Rogers et al. |
| 2002/0111571 | A1 | 8/2002 | Warwick et al. |
| 2006/0009718 | A1 | 1/2006 | Van Brunt et al. |

OTHER PUBLICATIONS

International Search Report for PCT/US06/25783.

Milla, Carlos E. et al., "High-Frequency Chest Compression: Effect of the Third Generation Compression Waveform," Instrument Research, Jul./Aug. 2004, pp. 322-328.

* cited by examiner

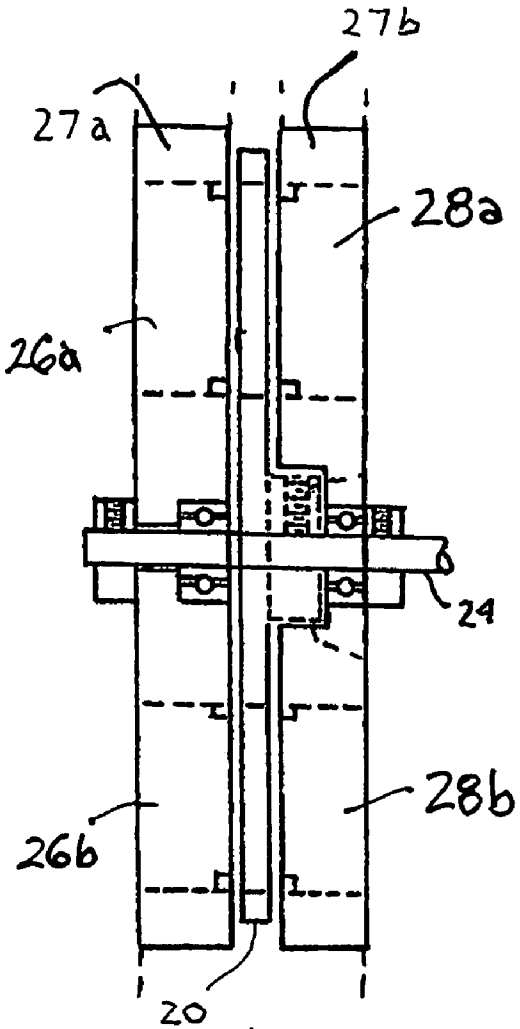
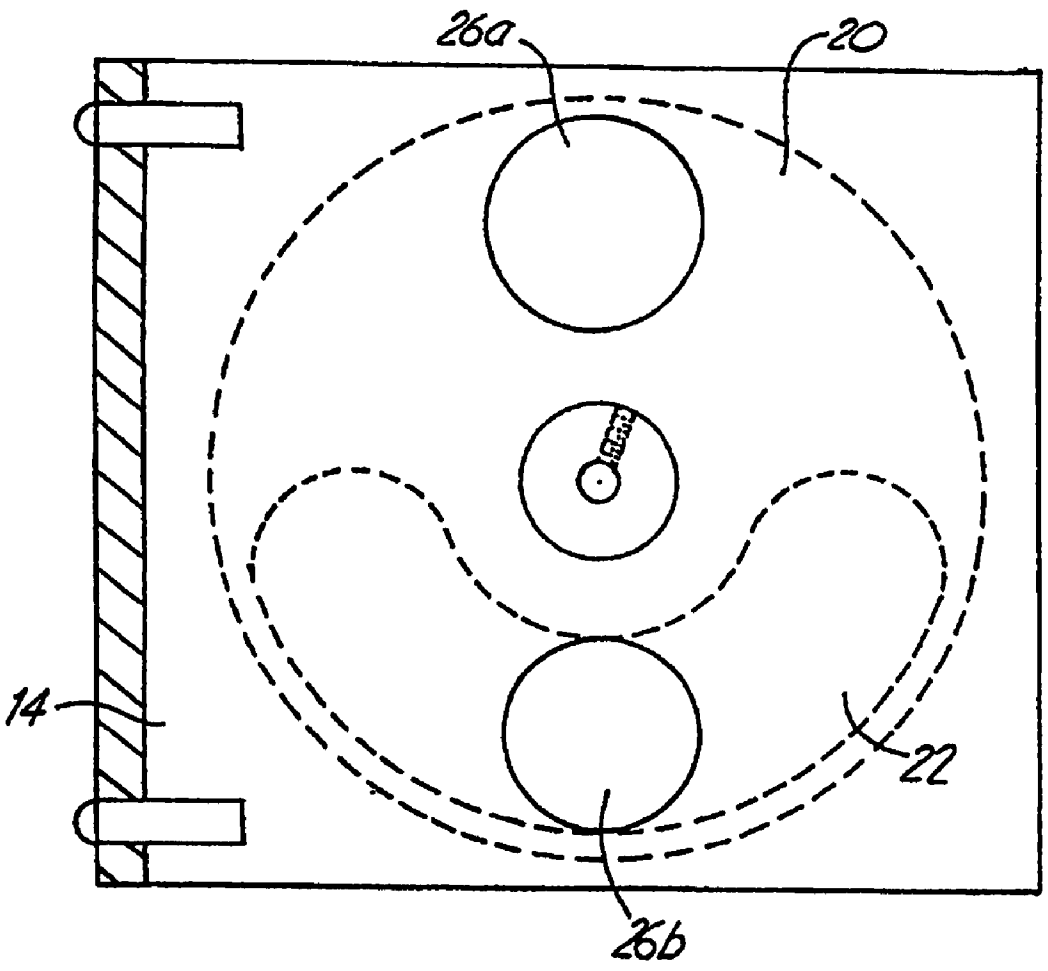
FIG. 2

Choose a Session Mode (QUICK START, ONE STEP, MULTI STEP)
To run QUICK START mode:
a) From the startup screen, select QUICK START.
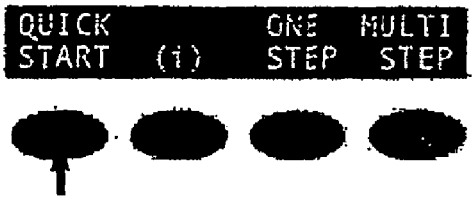
b) Your QUICK START session will begin. Adjust pressure by pressing either DOWN or UP. Press PAUSE to temporarily stop the session or END to return to the startup screen.
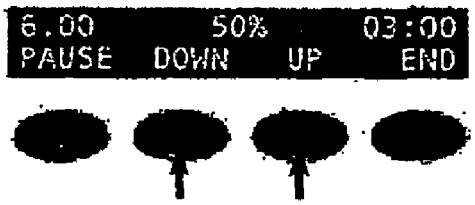
*FIG. 18* c) If the session is paused, press RUN to resume the session or END to return to the startup screen.

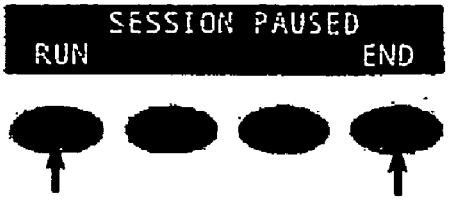

To run ONE STEP mode:

a) From the startup screen, press ONE STEP.

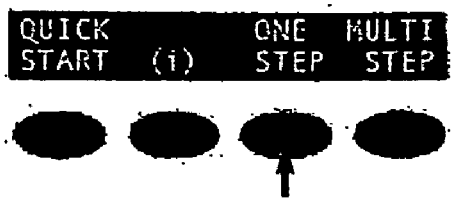

b) To run the last performed ONE STEP session, press RUN. To edit the session, go to step e within the ONE STEP mode instructions.

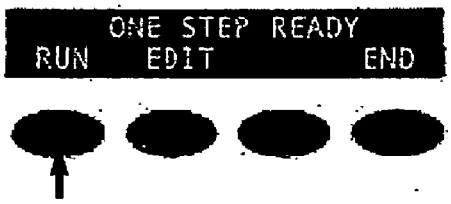

c) Your ONE STEP session will begin. Adjust pressure by pressing either DOWN or UP. Press PAUSE to temporarily stop the session or END to return to the startup screen.

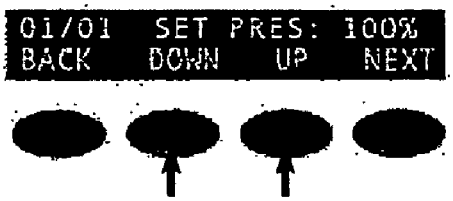

d) If the session is paused, press RUN to resume the session or END to return to the startup screen.

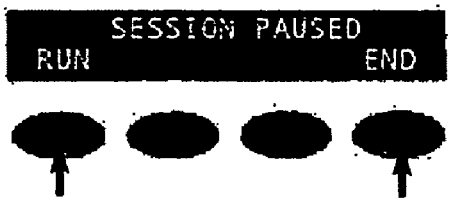

e) To edit the ONE STEP program, press EDIT.

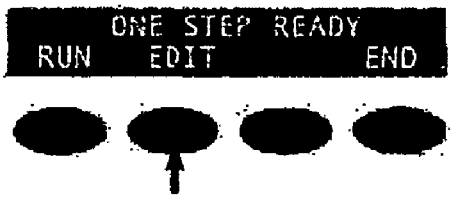

*FIG. 19* f) Press DOWN or UP to adjust frequency (FREQ) to desired level, then press NEXT.

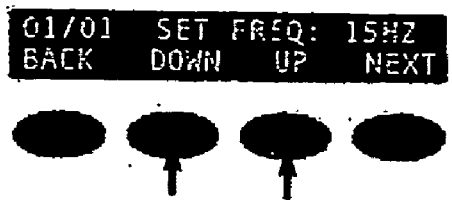

g) Press DOWN or UP to adjust pressure (PRES) to desired level, then press NEXT.

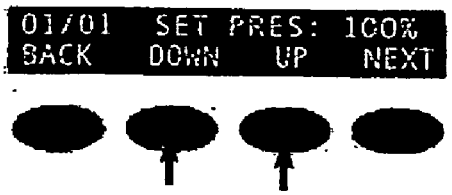

h) Press DOWN or UP to adjust the desired length of TIME, then press NEXT.

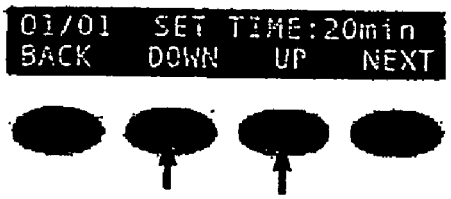

i) Your ONE STEP program is now ready to run. Press RUN and return to step c within the ONE STEP mode instructions.

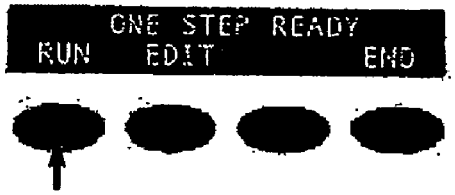

To run MULTI STEP mode:

a) From the startup screen, press MULTI STEP.

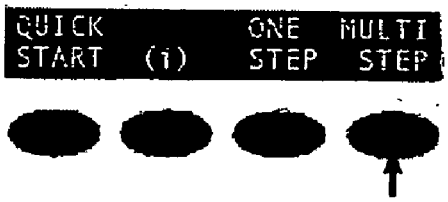

b) Select the program number you would like to run or edit. (PROGRAM 1 will be used as an example.)

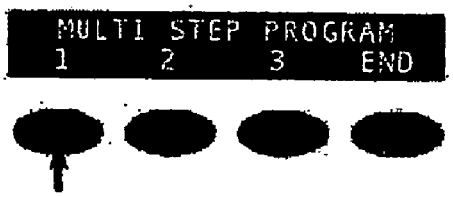

*FIG. 20* c) To run the previously saved program, press RUN. To edit the previously saved program, go to f within the MULTI STEP mode instructions.

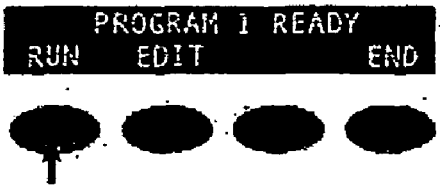

d) The PROGRAM 1 session will begin. Adjust pressure by pressing either DOWN or UP. Press PAUSE to temporarily stop the session or END to return to the startup screen.

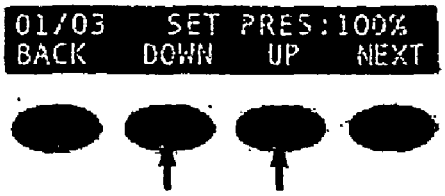

e) If the session is paused, press RUN to resume the session or END to return to the startup screen.

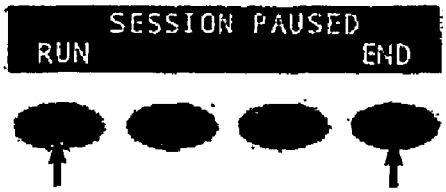

f) To edit PROGRAM 1, press EDIT.

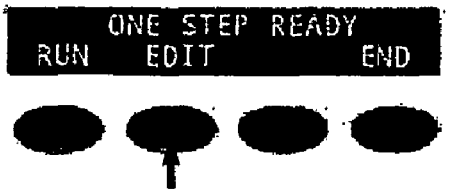

g) Press DOWN or UP to adjust desired number of steps, then press NEXT.

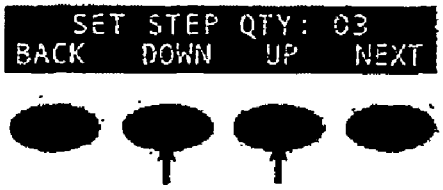

Note: You will need to set frequency, pressure, and time for each of the steps.

Note: Three steps will be displayed in this example.

*FIG. 21* h) Press DOWN or UP to adjust frequency (FREQ) to desired level, then press NEXT.

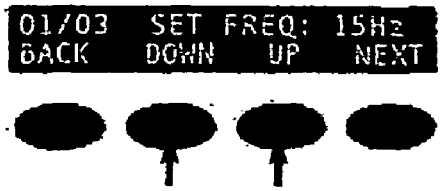

i) Press DOWN or UP to adjust pressure (PRES) to desired level, then press NEXT.

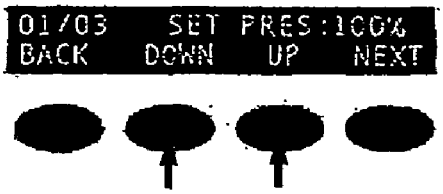

j) Press DOWN or UP to adjust the desired length of TIME, then press NEXT.

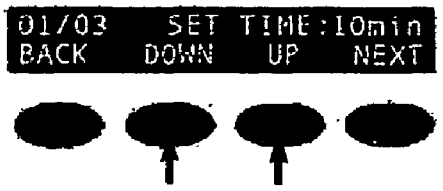

Note: As you complete programming for each step, the display will briefly show your progress.

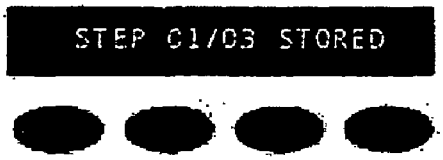

k) When you have completed this step, the display will proceed to the next step for programming and update the display to "02/03" showing that you are now programming the second of three steps.

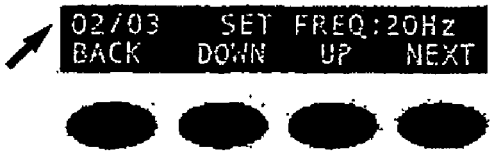

l) Repeat steps h through j of the MULTI STEP mode instructions until all steps are programmed. The screen will automatically bring you to the PROGRAM 1 READY screen.

Press RUN and return to step c within the MULTI STEP mode instructions.

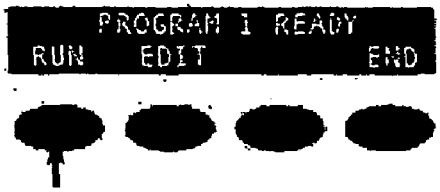

*FIG. 22*

CHEST COMPRESSION APPARATUS

RELATED APPLICATIONS

This application claims the benefit of U.S. Provisional Application No. 60/716,404, filed Sep. 12, 2005, and incorporated by reference herein.

This application is a CIP of U.S. Ser. No. 11/204,547, filed Aug. 15, 2005, now U.S. Pat. No. 7,597,670 which was a CIP of U.S. Ser. No. 10/038,208, now U.S. Pat. No. 6,958,046, filed Jan. 2, 2002, which was a continuation of PCT/US00/18037, filed Jun. 29, 2000, which claimed the benefit of U.S. Provisional Application No. 60/142,112, filed Jul. 2, 1999.

TECHNICAL FIELD

The present invention relates to oscillatory chest compression devices and more particularly to an air pulse system having multiple operating modes.

BACKGROUND OF THE INVENTION

A variety of high frequency chest compression ("HFCC") systems have been developed to aid in the clearance of mucus from the lung. Such systems typically involve the use of an air delivery device, in combination with a patient-worn vest. Such vests were developed for patients with cystic fibrosis, and are designed to provide airway clearance therapy. The inflatable vest is linked to an air pulse generator that provides air pulses to the vest during inspiration and/or expiration. The air pulses produce transient cephalad air flow bias spikes in the airways, which moves mucous toward the larger airways where it can be cleared by coughing. The prior vest systems differ from each other, in at least one respect, by the valves they employ (if any), and in turn, by such features as their overall weight and the wave form of the air produced.

BRIEF SUMMARY OF THE INVENTION

The present invention is directed to a chest compression apparatus for applying a force to the thoracic region of the patient. The force applying mechanism includes a vest for receiving pressurized air. The apparatus further includes a mechanism for supplying pressure pulses of pressurized air to the vest. For example, the pulses may have a sinusoidal, triangular, square wave form, etc. Additionally, the apparatus optionally includes a mechanism for venting the pressurized air from the bladder. In addition to performance that is comparable to, if not better than, that provided by prior devices, the apparatus of the present invention can be manufactured and sold for considerably less than current devices, and can be provided in a form that is far more modular and portable than existing devices.

In a preferred embodiment of the present invention, a fan valve is used to establish and determine the rate and duration of air pulses entering the vest from the pressure side and allow air to evacuate the bladder on the depressurizing side. An air generator (e.g., blower) is used on the pressurizing side of the fan valve. The fan valve advantageously provides a controlled communication between the blower and the bladder.

The present apparatus provides a variety of solutions and options to the treatment problem faced by people having cystic fibrosis. The advantages of the invention relate to benefits derived from a treatment program using the present apparatus rather than a conventional device having a rotary valve and corresponding pulses. In this regard, a treatment program with the present apparatus provides a cystic fibrosis patient with independence in that the person can manipulate, move, and operate the machine alone. He/she is no longer required to schedule treatment with a trained individual. This results in increased psychological and physical freedom and self esteem. The person becomes flexible in his/her treatment and can add extra treatments, if desired, for instance in order to fight a common cold. An additional benefit is the corresponding decrease in cost of treatment, as well as a significant lessening of the weight (and in turn, increased portability) of the device itself.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which:

FIG. 2*a* is a side elevational view of a portion of a blade valve suitable for use with an embodiment of the present invention.

FIG. 2*b* is another side elevational view of a blade valve of FIG. 2*a*.

FIGS. 18-22 depict a user interface with the apparatus of FIGS. 6-16.

DETAILED DESCRIPTION OF THE INVENTION

Figure 1:
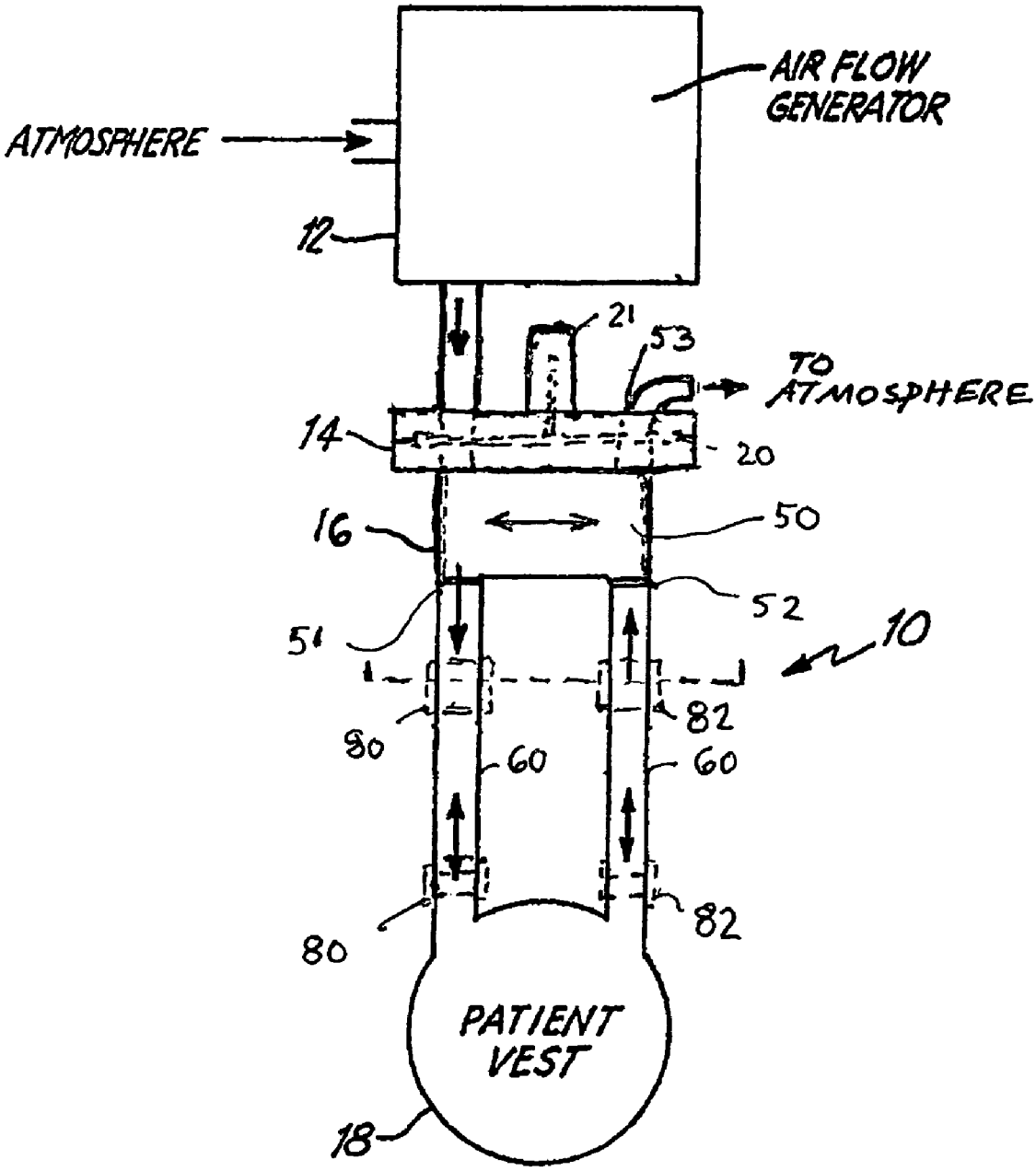
FIG. 1 is a depiction of functional aspects of an air system according to the present invention, with arrows depicting air flow therethrough.

An embodiment of a chest compression system according to the present invention is referenced herein by the numeral 10. FIG. 1 shows an air flow diagram associated with system 10. System 10 includes an air flow generator component 12, flowably connected to a pulse frequency control module 14, which in turn is flowably connected to a pressure control device 16, and finally to a vest 18 worn by the patient. The patient may be a human or other animal. For example, both human and equine applications may be practicable, with differently sized vests 18 being defined by the particular applications. In use, the air flow generator (e.g., motor driven blower) delivers pressurized air to vest 18, via pulse frequency control unit 14 that preferably includes one or more rotating (e.g., fan-like) blades. Air flow generator 12 includes an electric blower, the speed of which may be fixed or variable depending on an application.

FIG. 2 depicts pulse frequency control unit 14. Unit 14 includes a generally circular valve blade 20, rotatable upon a central axis of motor 21 and having one or more cutout portions 22. Blade 20 is retained on a centrally located motor driven shaft 24, which serves to rotate blade 20, and in turn, provide airflow access to and through air ports 26*a* and 26*b*, respectively. Motor 21 is coupled to motor shaft 24 and provides rotational control of blade 20. Motor 21 is a stepper motor providing accurate control of blade 20 position in order to define particular waveforms applied to vest 18. As shown in corresponding FIG. 2*b*, a pair of end plates 27*a* and 27*b* are mounted on an axis concentric with that of motor drive shaft 24, and effectively sandwich the blade assembly between them. The end plates are provided with corresponding air ports 26*a* and 26*b* (in plate 27*a*) and 28*a* and 28*b* (in plate 27*b*). The air ports are overlapping such that air delivered from the external surface of either end plate will be free to exit the corresponding air port in the opposite plate, at such times as the blade cutout portion of the valve blade is itself in an overlapping position therebetween. By virtue of the rotation of cutout portions past the overlapping air ports, in the course of constant air delivery from one air port toward the other, the rotating fan blade effectively functions as a valve to permit air to pass into the corresponding air port in a semi-continuous and controllable fashion. The resultant delivery may take a sinusoidal wave form, by virtue of the shape and arrangement of the fan blade cutout portions.

Pulse frequency module 14, in a preferred embodiment, is provided in the form of a motor-driven rotating blade 20 ("fan valve") adapted to periodically interrupt the air stream from the air flow generator 12. During these brief interruptions air pressure builds up behind the blade. When released, as by the passage of blade 20, the air travels as a pressure pulse to vest 18 worn by the patient. The resulting pulses can be in the form of fast rise, sine wave pressure pulses. Alternative waveforms can be defined through accurate control of blade 20, such as via an electronically controlled stepper motor. These pulses, in turn, can produce significantly faster air movement in the lungs, in the therapeutic frequency range of about 5 Hz to about 25 Hz, as measured at the mouth. In combination with higher flow rates into the lungs, as achieved using the present apparatus, these factors result in stronger mucus shear action, and thus more effective therapy in a shorter period of time.

Fan valve 20 of the present invention can be adapted (e.g., by configuring the dimensions, pitch, etc. of one or more fan blades) to provide wave pulses in a variety of forms, including sine waves, near sine waves (e.g., waves having precipitous rising and/or falling portions), and complex waves. As used herein a sine wave can be generally defined as any uniform wave that is generated by a single frequency, and in particular, a wave whose amplitude is the sine of a linear function of time when plotted on a graph that plots amplitude against time. The pulses can also include one or more relatively minor perturbations or fluctuations within and/or between individual waves, such that the overall wave form is substantially as described above. Such perturbations can be desirable, for instance, in order to provide more efficacious mucus production in a manner similar to traditional hand delivered chest massages. Moreover, pulse frequency module 14 of the present invention can be programmed and controlled electronically to allow for the automatic timed cycling of frequencies, with the option of manual override at any frequency.

Figure 4:
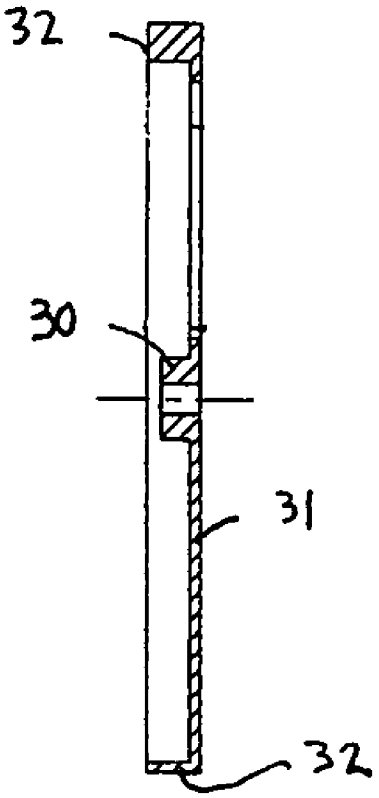
FIG. 4 is a cross sectional view of the blade of FIG. 3, taken along lines 4-4.
Figure 3:
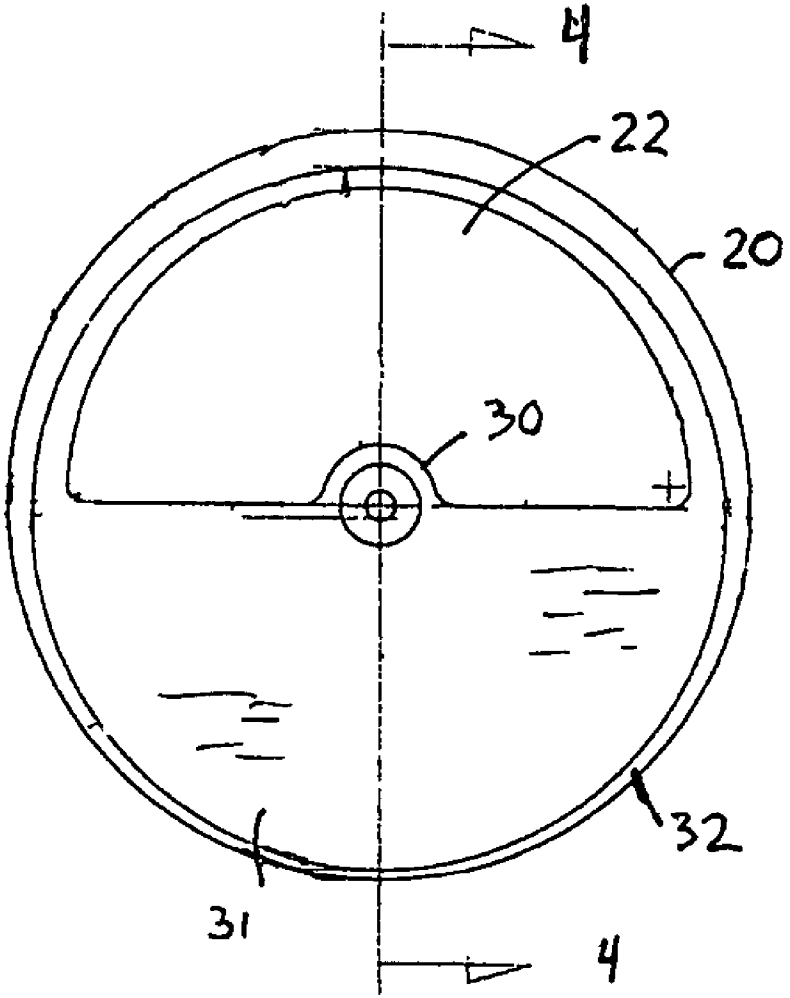
FIG. 3 is a top plan view of a rotationally balanced blade suitable for use within a rotary blade valve including within an embodiment of the present invention.

Referring to FIGS. 3 and 4, blade 20 includes hub 30, a base plate element 31 and a variable thickness outer wall 32. Outer wall 32 is thinner in the region generally opposite cutout portion 22 and thicker proximate to the cutout portion 22. Preferably the outer wall 32 thickness is varied in order to statically and dynamically balance the blade 20. By balancing blade 20, a reduction in vibration and noise can be provided.

Figure 5:
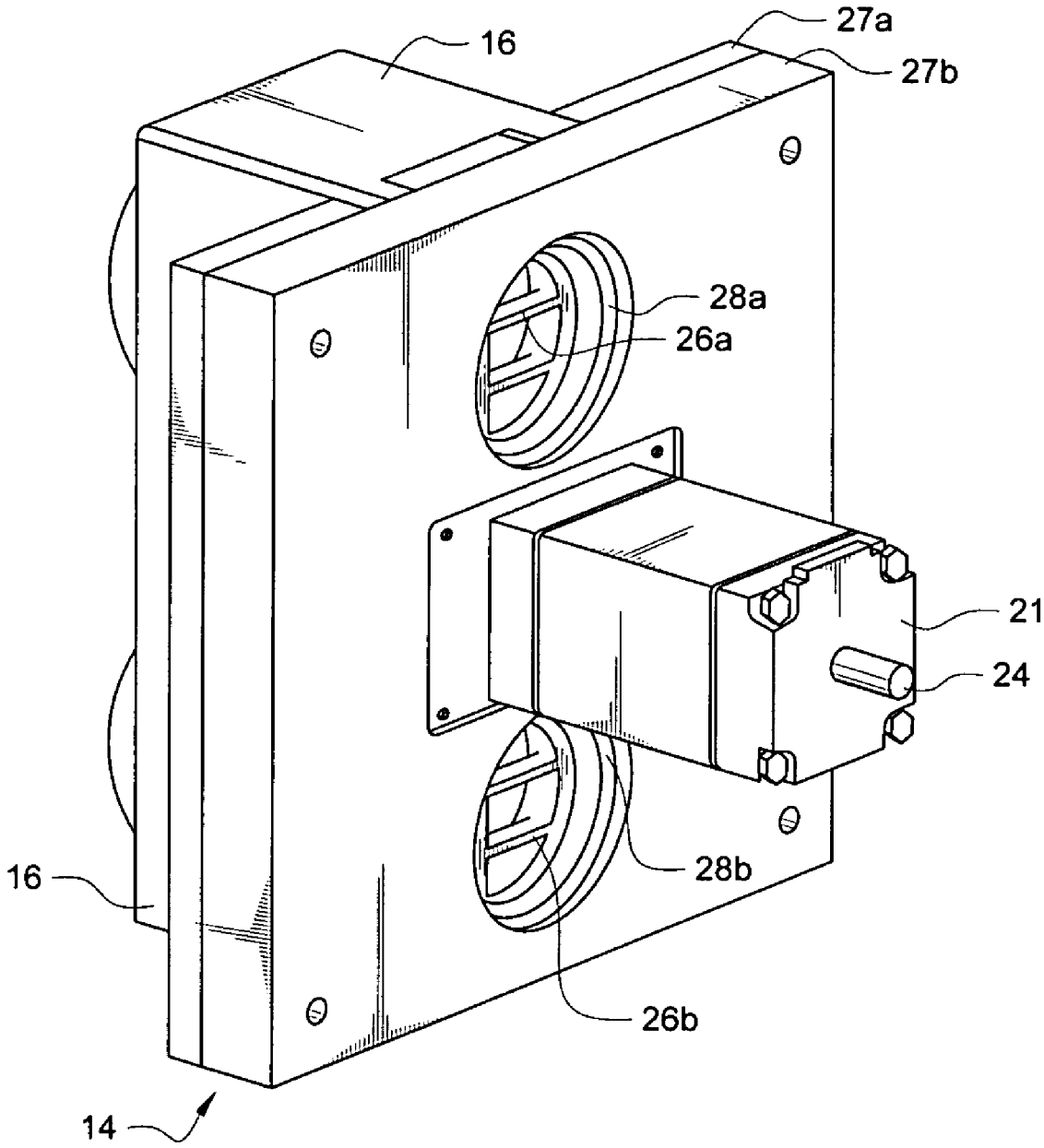
FIGS. 5 and 6 are perspective view of internal components of an apparatus according to the present invention.
Figure 6:
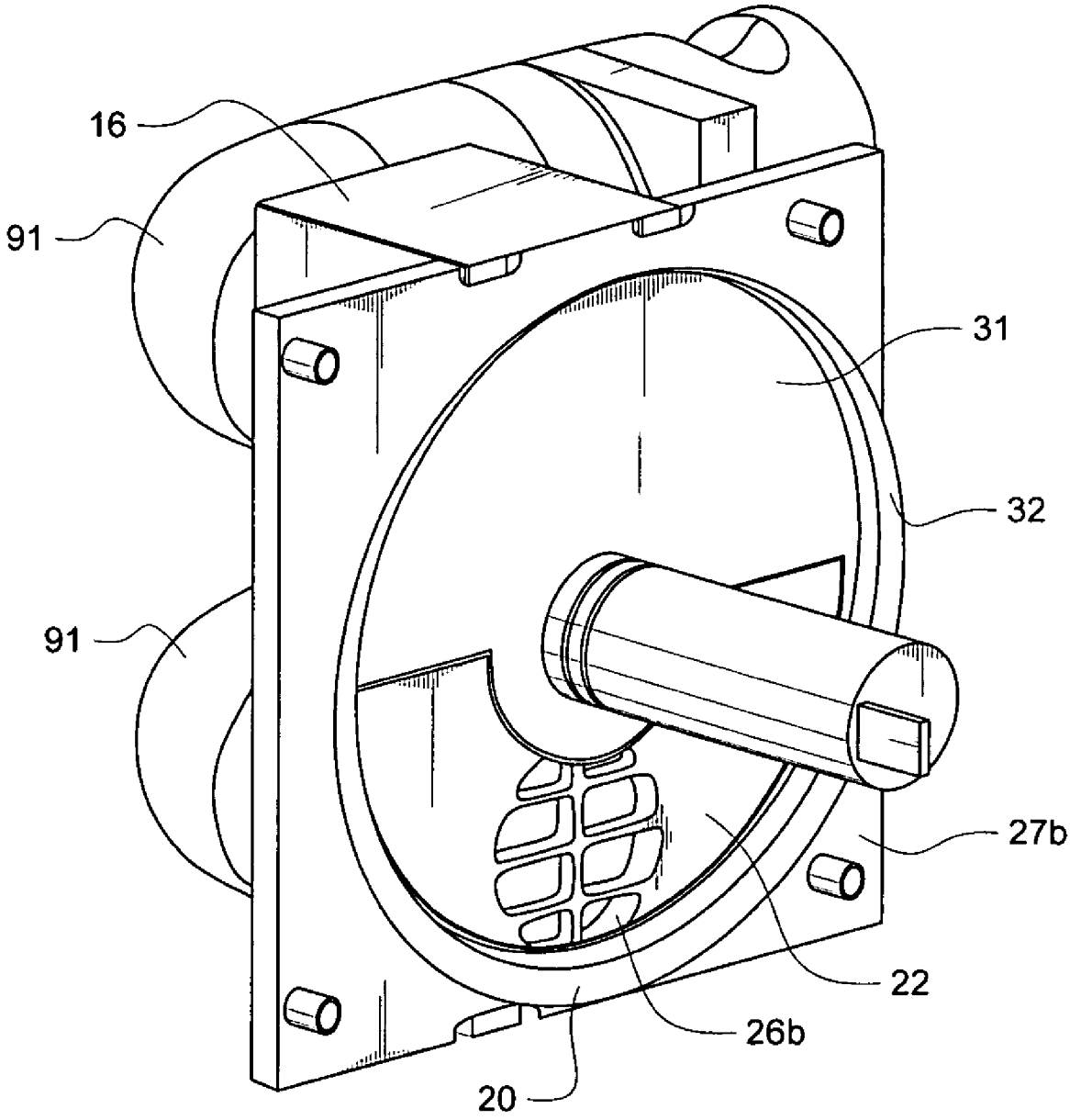
Figure 8:
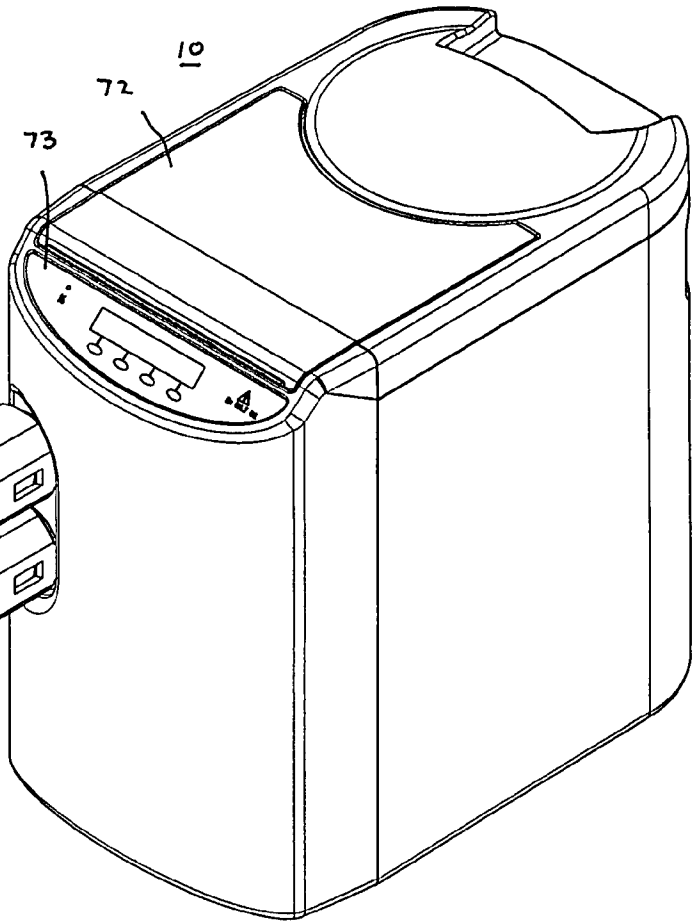
FIGS. 7-13 illustrate external aspects of an embodiment of an apparatus according to the invention.
Figure 7:
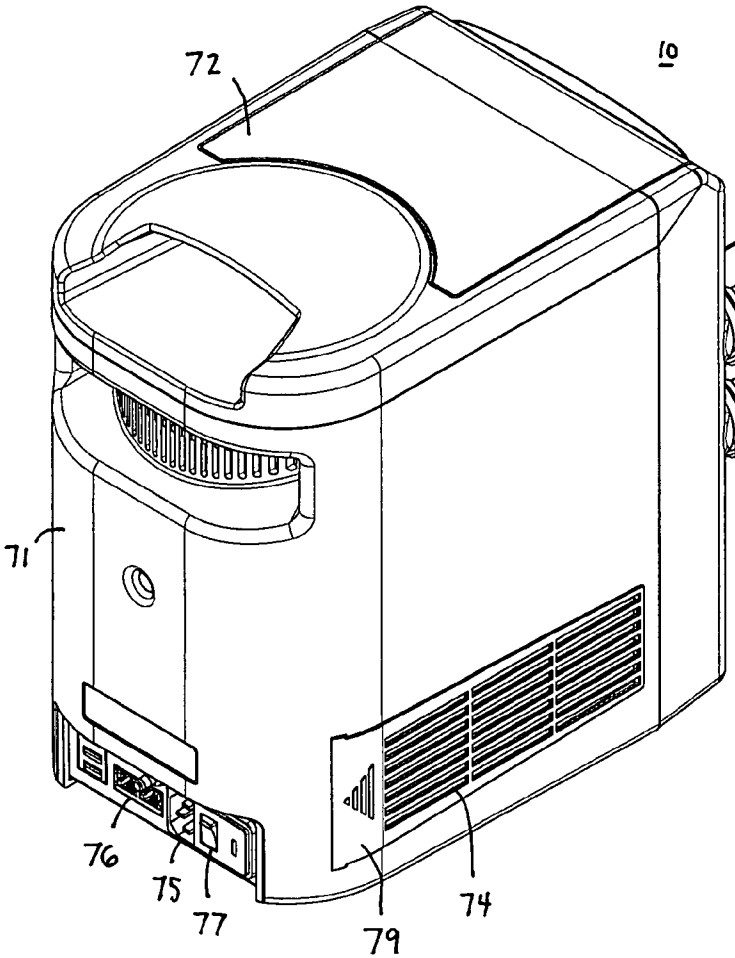
Figure 10:
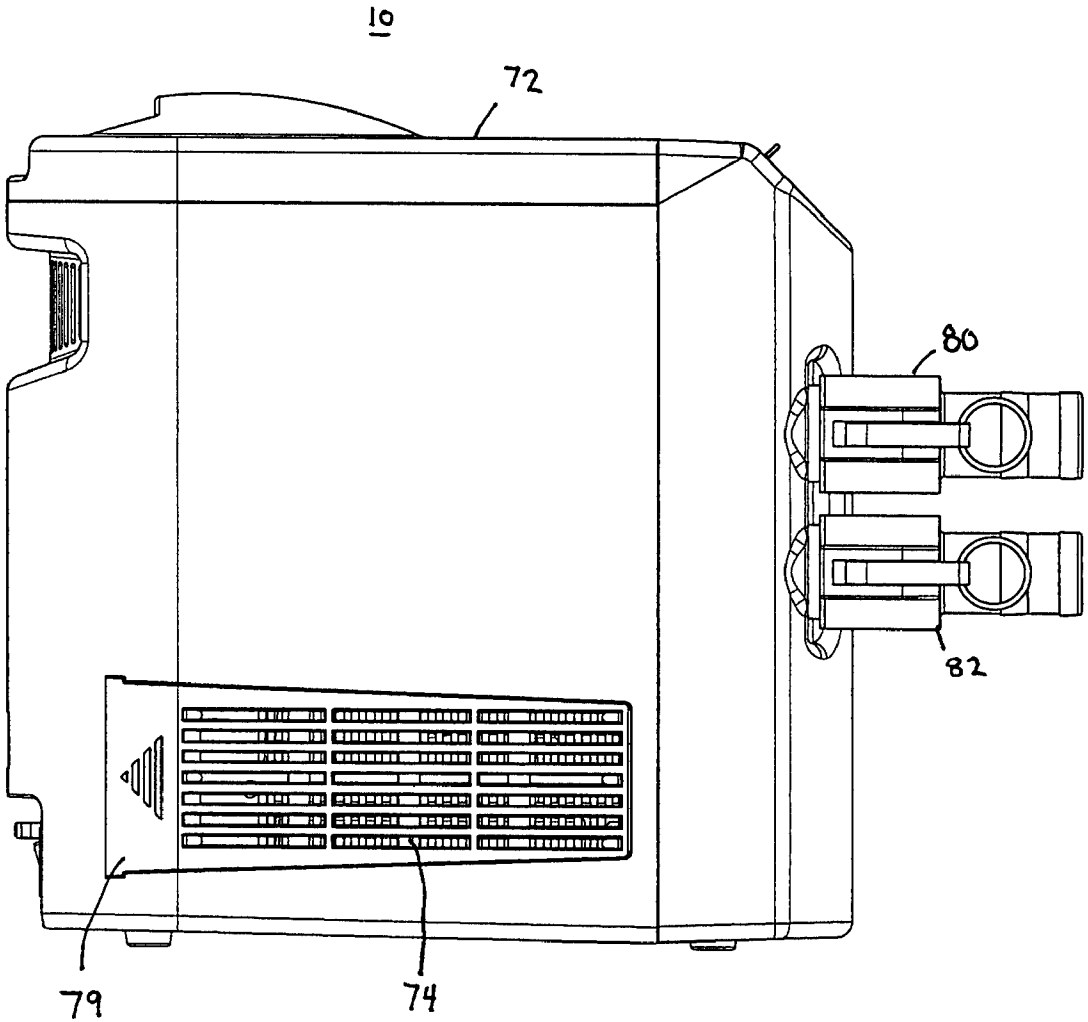
Figure 9:
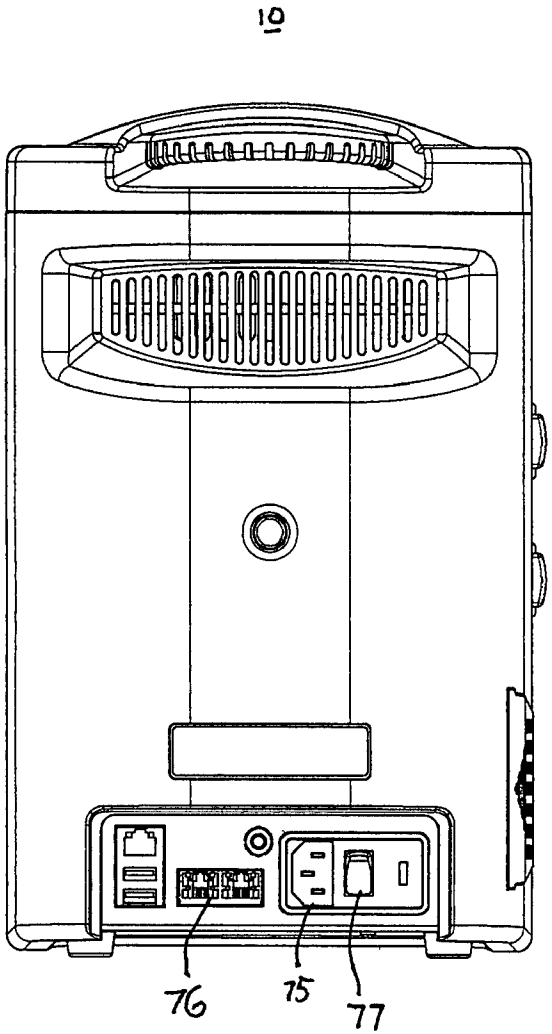
Figure 12:
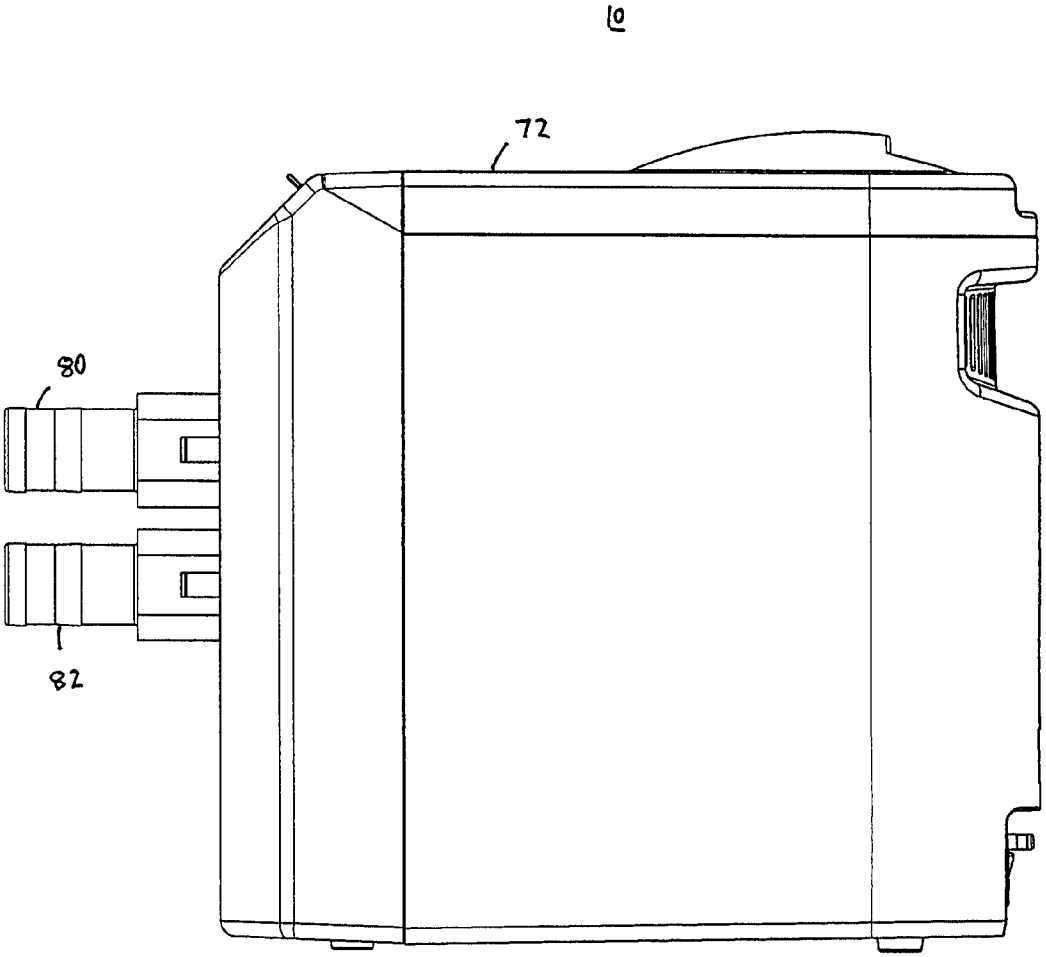
Figure 11:
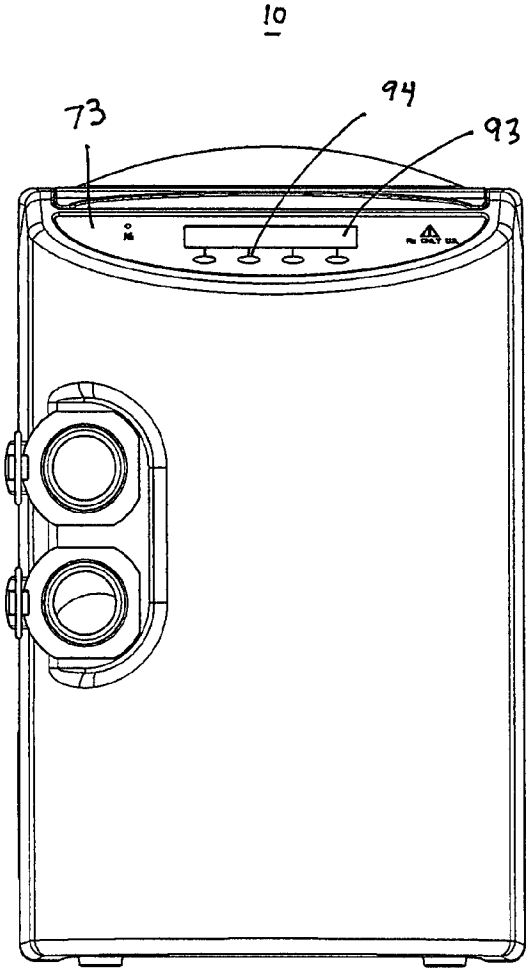
Figure 13:
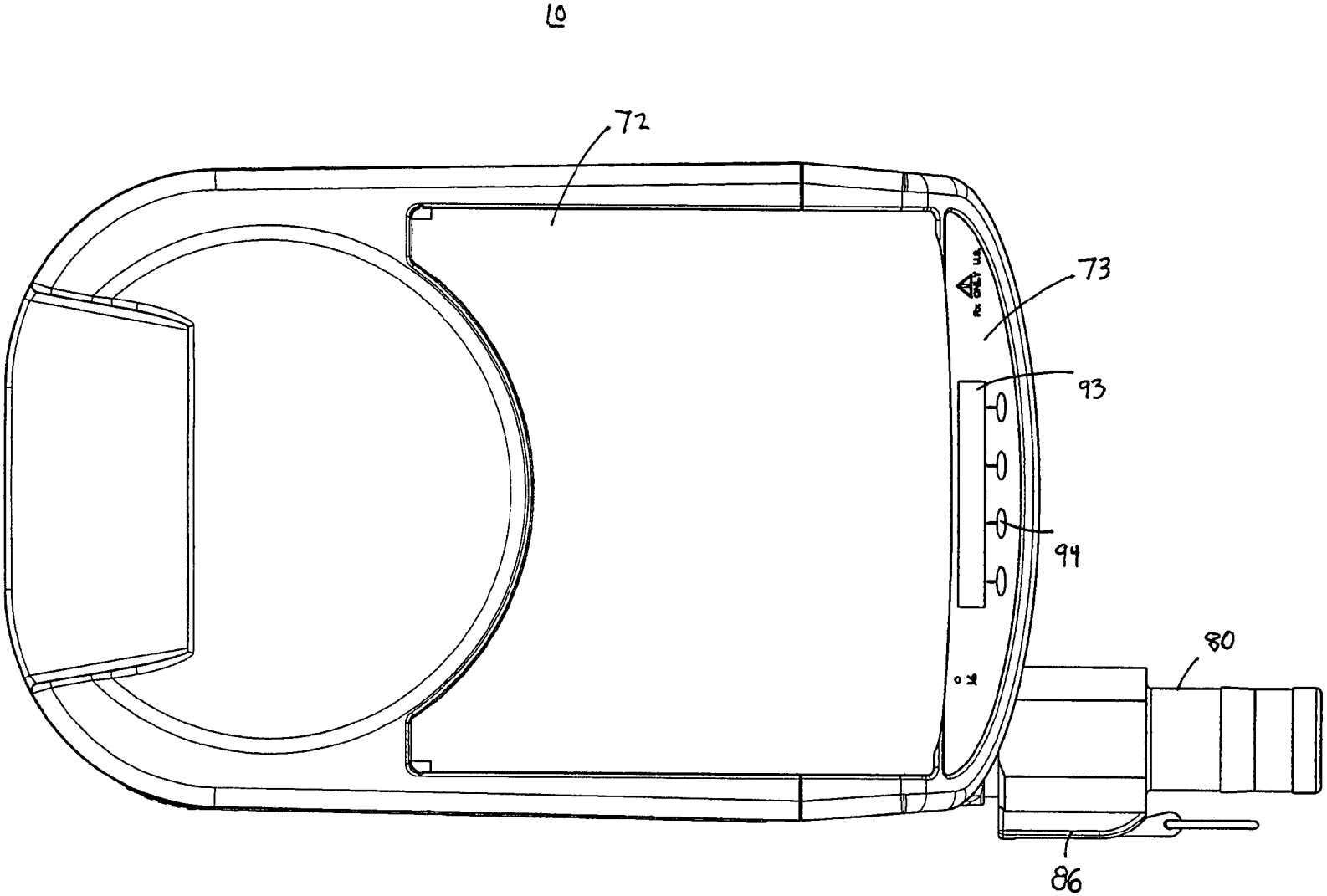

Referring to FIGS. 5 and 6, pressure control unit 16 defines a balancing chamber 50 in air communication with ports 26*a* and 26*b* of module 14. Chamber 50 is adapted to receive or pass air through ports 26*a* and 26*b* of pulse frequency control module 14, and effectively provides a manifold or air chamber to deliver air to vest 18 or atmosphere by means of vest exit ports 51, 52 and atmosphere exit port 53. As depicted in FIG. 1, air chamber 50 of pressure control unit 16 provides fluid communication between ports 51, 52 and 53, and hence fluid communication between the ports of pulse frequency control module 14 and air lines 60 to patient vest 18. During operation, air chamber 50 receives HFCC pulse pressure waves through ports 26*a*, 28*a*. Port 53 is connected to port 28*b* of frequency control module 14 and is closed to atmosphere when 26*a* is open and open when 26*a* is closed. Ports 51 and 52 are connected to the inflatable vest 18 via flexible tubing 60.

Pulse pressure control 16 is located between frequency control module 14 and vest 18 worn by the patient. In the illustrated embodiment, air chamber 50 is immediately adjacent pulse frequency control module 14. In one preferred embodiment, a structure defining the air chamber is directly connected to the outlet ports of the pulse frequency control module 14. The manifold or air chamber 50 provides fluid communication between air lines 60 extending to vest 18 and the bladder-side ports of the pulse frequency control module 14. Pressure control unit 16 may be active or passive. For example, an active pressure control unit may include, for example, valves and electric solenoids in communication with an electronic controller, microprocessor, etc. A passive pressure control unit 16 may include a manual pressure relief or, in a simple embodiment, pressure control unit 16 may include only the air chamber providing air communication between the air lines extending to the vest 18 and not otherwise including a pressure relief or variable pressure control.

FIGS. 7-13 illustrate external aspects of system 10. System 10 includes shell or housing 70 having front portion 71 and top portion 72. Front portion 71 includes user interface 73. System 10 defines air openings 74, electrical connection 75, telecom connections 76, and power switch 77. User interface 72 allows the patient to control device 10. Air openings 74 permit air entry into system 10. A removable filter 79 (FIG. 15) is adapted to be periodically removed and cleaned to minimize debris entry into system 10.

System 10 further includes a plurality of quick connect air couplings 80, 82 which couple vest 18 with system 10 components within housing 70 via air hoses 60. Each quick connect air coupling 80, 82 includes male and female portions and a latch 86 or other release for quickly disconnecting the portions. The benefits of the quick connect air couplings include minimization of inadvertent air hose disconnects and improved freedom of movement as the locking air coupling permit rotation between the air hose and the vest or air generator.

Figure 14:
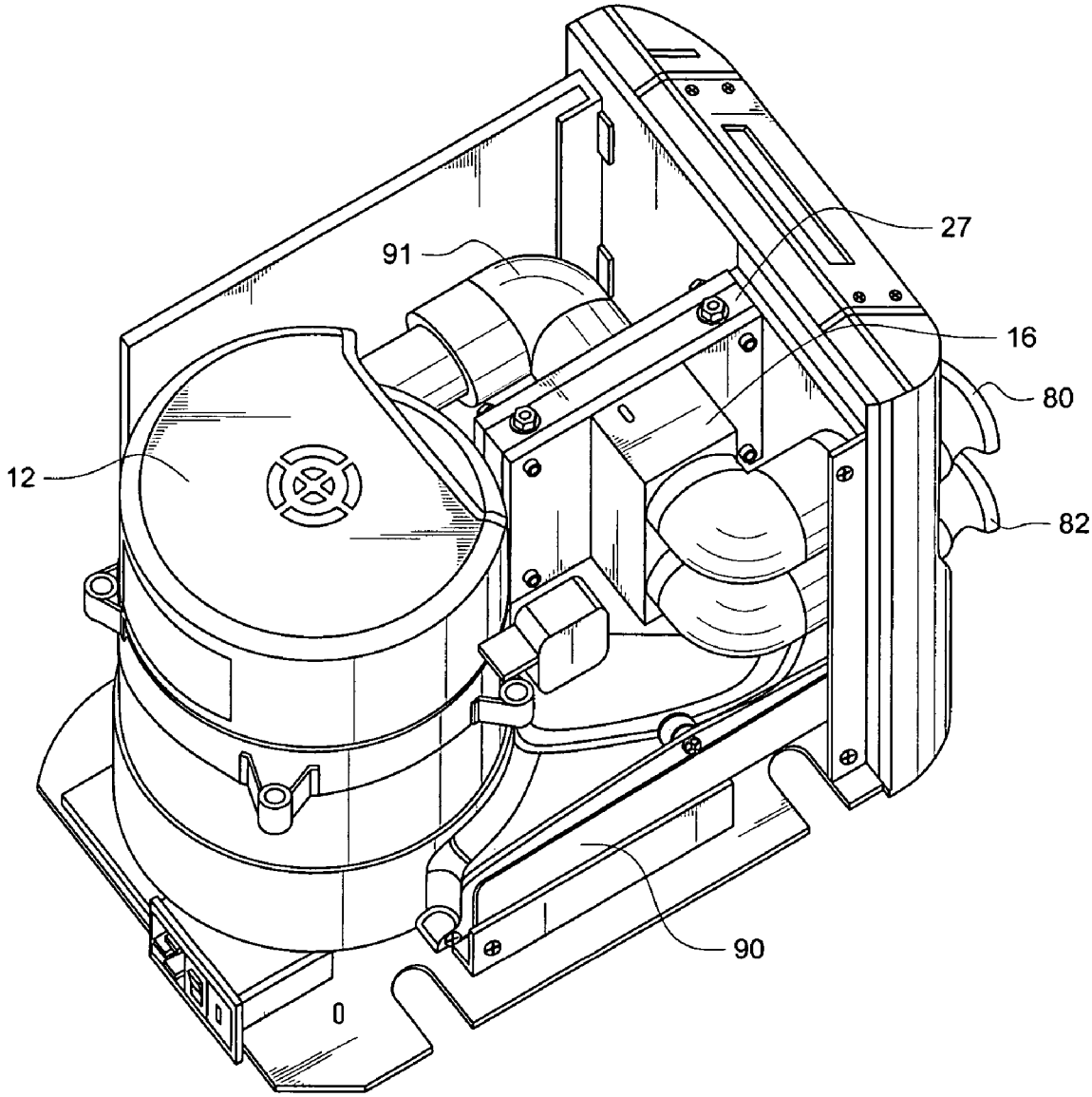
FIGS. 14-16 are perspective views of internal portions of the embodiment of FIGS. 7-13.
Figure 15:
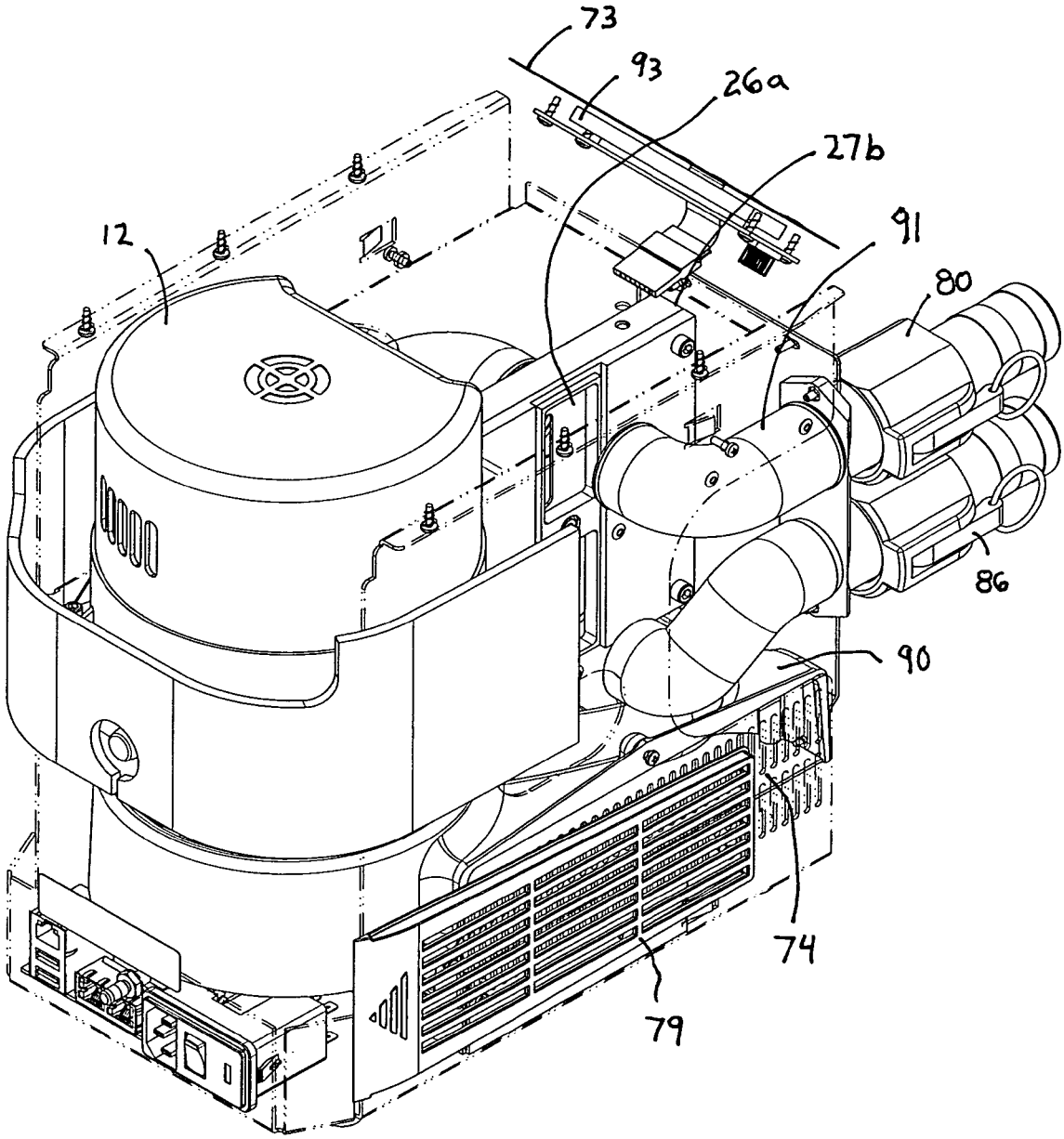
Figure 16:
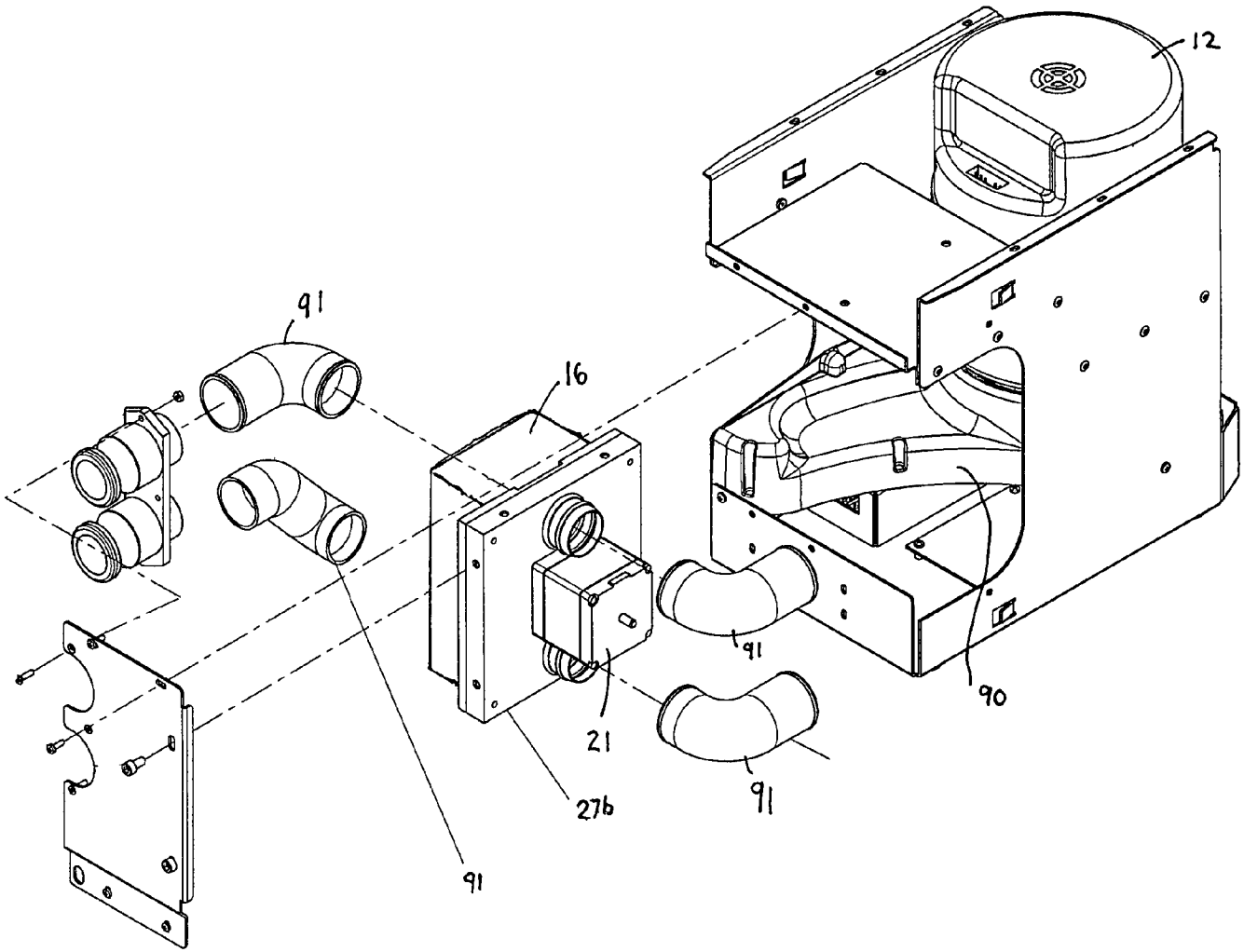

Referring to FIGS. 14-16, internal components of system 10 are shown. Plenum 90 is defined between air flow generator 12 and external housing 70. Plenum 90 defines an air conduit between for air entering system 10. Plenum 90 includes a pair of openings, one positioned near opening 74 and the other positioned at an inlet to the electric blower motor of air flow generator 12. Plenum 90 is provided with a generally decreasing cross sectional volume as it extends from air opening 74 towards the inlet of air flow generator 12. Plenum 90 promotes a reduction in sound generation as air is more efficiently drawn into generator 12 as compared to an open fan inlet. Tubular couplings 91 provide fluid communication to air flow generator 12 to control devices 14, 16 and quick connect air couplings 80, 82.

Figure 17:
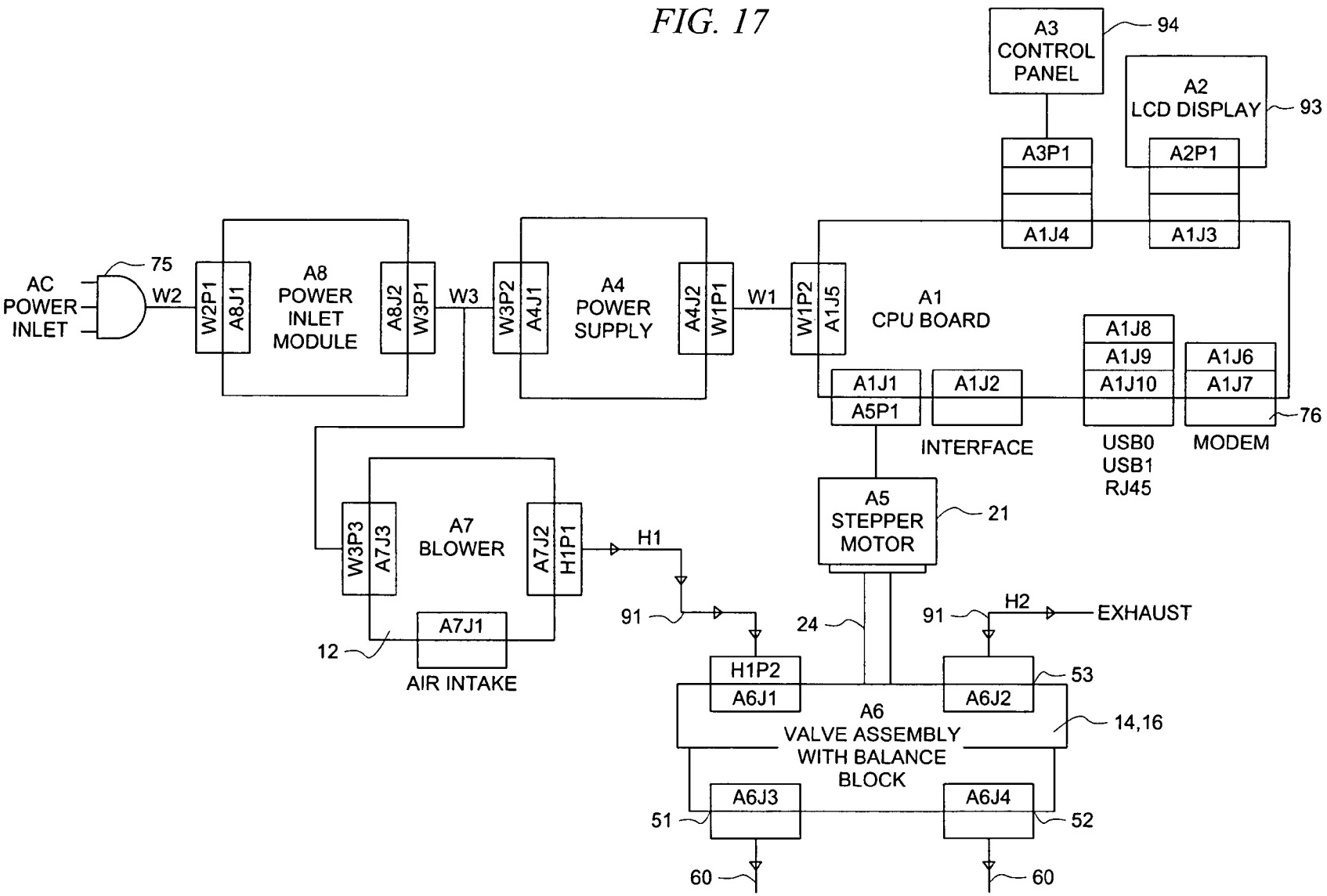
FIG. 17 is an electric and pneumatic schematic of the apparatus of FIGS. 6-16.

FIG. 17 illustrates an electrical and pneumatic schematic of system 10. Controller 160 is connected to modem interface 76 permitting communication to and from system 10 to a remote location. Examples of communication include monitoring of system 10 performance, updating software used by controller 160 monitoring patient compliance, performing remote system diagnostics, etc. Controller 160 provides control of stepper motor 21 providing rotational control to fan 20.

In operation, user interface 73 allows the patient to control system 10. The patient controls activation/deactivation of system 10 through on/off control switch 77. User interface 73 includes display panel 93 and multifunctional keypad 94. Display panel 93 is preferably an LCD panel display, although other displays, such as LED, could also be used. Display panel 110 shows the status of system 10 and options available for usage. Keypad 94 is preferably an elastomeric or rubber keypad. The patient may modify operation of system 10. System 10 also provides feed back to the patient as to its status. The messages are displayed as text on display panel 93.

User interface 28 also allows operation of system 10 in several different modes, such as QUICK START, ONE STEP or MULTI STEP. FIGS. 18-22 illustrate operation of the modes.

QUICK START mode allows system 10 to provide a 30 minute ramping session, wherein the session is divided into 10 mini-sessions of 3 minutes. Pressure is set at 50% and is adjustable by the patient during the session. The frequency of air pulses ramps from 6 Hz to 15 Hz over a 3 minute period, then ramps from 15 Hz to 6 Hz for the next 3 minutes and repeats for a total of 30 minutes. Frequency represents the frequency of air pulses delivered to vest 18.

ONE STEP mode allows system 10 to provide traditional non-ramping HFCC therapy. Air pressure is set at a desired pressure and is adjustable during use. The frequency can be user defined between 5 Hz to 30 Hz.

MULTI STEP mode allows system 10 to provide customized therapy with multiple steps and ramping. Each session length can be user defined. Pressure and frequency at each step is also user defined and is adjustable during use.

Ramping operation presets system 10 to sweep over a range of oscillation frequencies, for example, while maintaining the same bias or steady state air pressure component. The oscillation frequency sweeps between the two end points incrementally changing the oscillation frequency. For example, the oscillation frequency incrementally increases until it reaches the high frequency, then incrementally decreases the oscillation frequency to the low frequency, then the oscillation frequency incrementally increases again. Alternatively, the oscillation frequency incrementally increases to the high frequency then returns to the low frequency and incrementally increases to the high frequency. The incremental increasing and decreasing continues throughout the treatment, or until the settings are reset. It is believed that the low frequencies are more effective at clearing small airways, and high frequencies more effective at clearing larger airways. The speed of the sweep is programmable through user interface 28 or preset.

Figure 23:
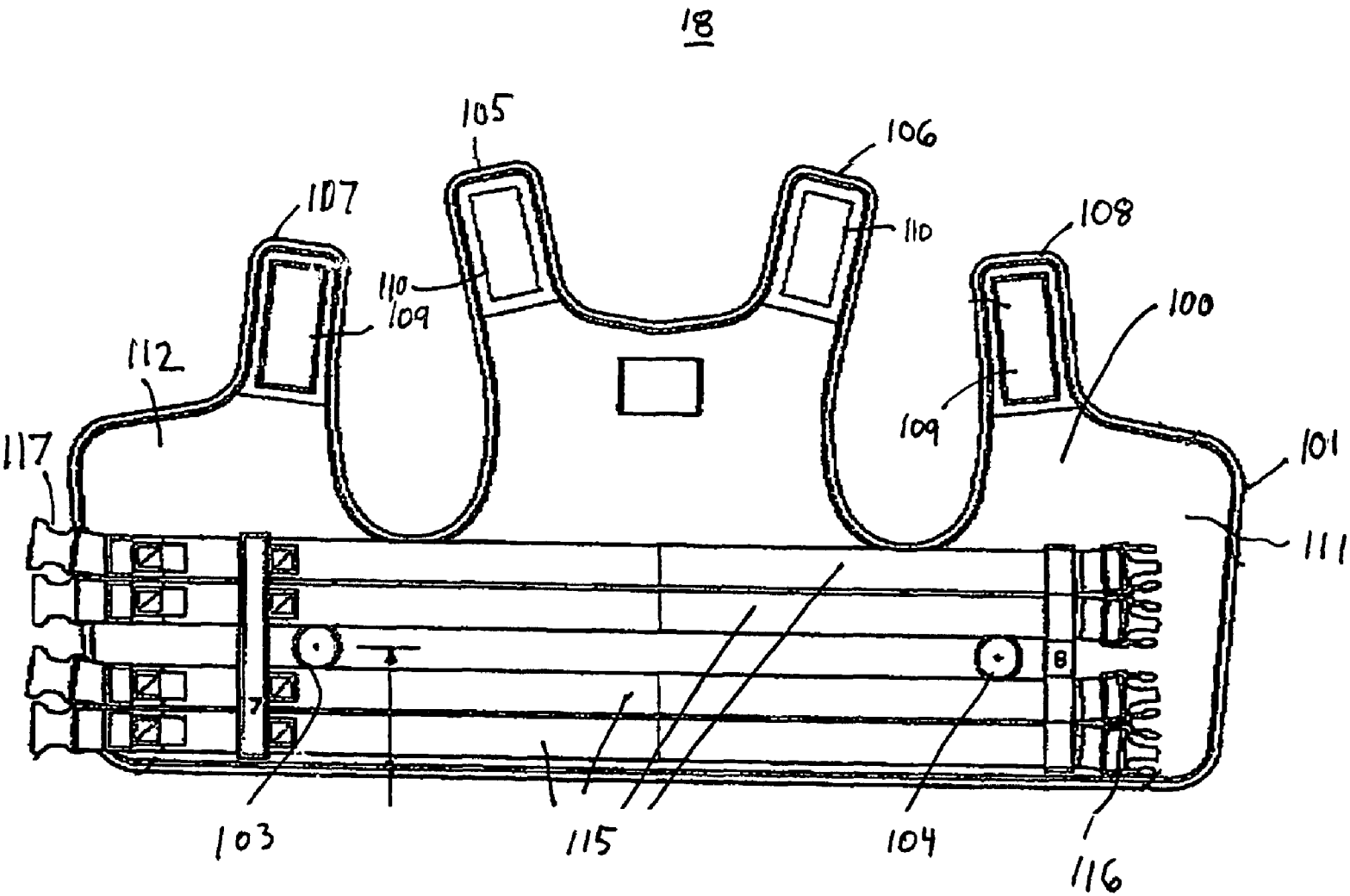
FIG. 23 is top view of a patient vest suitable for use with an air pulse system.

Vest 18 is utilized to provide high frequency chest wall oscillations or pulses to enhance mucus clearance in a patient with reduce mucocilliary transport. Vest 18 is adapted to be located around the patient's upper body or thorax and supported at least partially on the patient's shoulders. Vest 18 is expanded into substantial surface contact with the exterior of the patient's upper body to apply repeated pressure pulses to the patient. Referring to FIG. 23, vest 18 has an inside cover 100 comprising a non-elastic material, such as nylon fabric. Other types of materials can be use for cover 100. Cover 100 is secured to a flexible inside liner 101 located adjacent and around patient's body. An air core or bladder having an internal air chamber and a pair of air receiving ports 103, 104 is defined between cover 100 and liner 101.

Vest 18 has a pair of upright shoulder straps 105 and 106 laterally separated with a concave upper back edge. Upright front chest portions 107 and 108 are separated from straps 105 and 106 with concave curved upper edges which allow vest 18 to fit under the patient's arms. Releasable fasteners, such as loop pads 109 and 110 cooperated with hook pads secured to the insides of shoulders straps 105 and 106 to releasably secure shoulder straps 105 and 106 to chest portions 107 and 108. Vest 18 has a first lateral end flap 111 extending outwardly at the one side of the vest. A second lateral end flap 112 extends outwardly from the other side of the vest 18.

Figure 24:
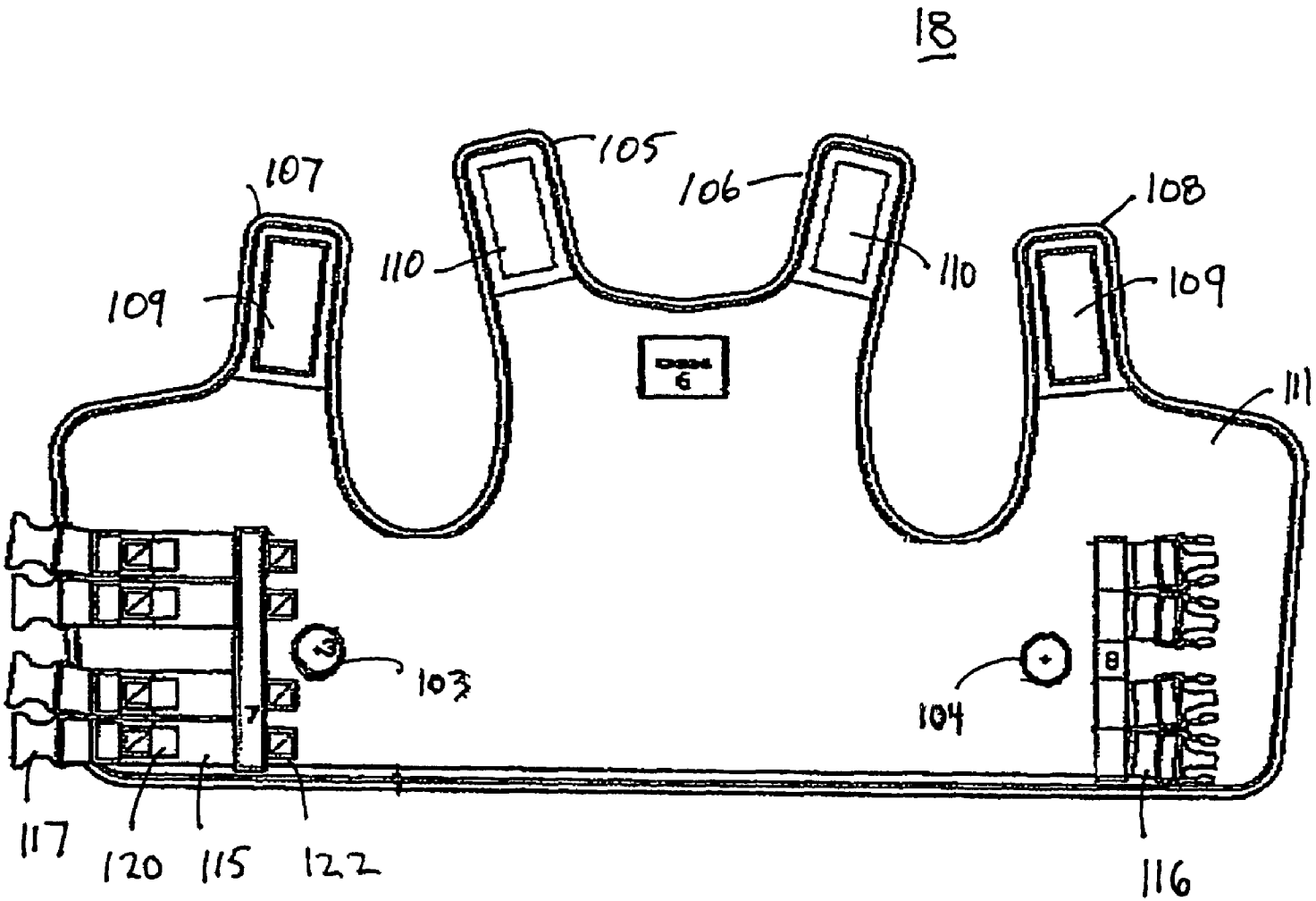
FIG. 24 is top view of another embodiment of a patient vest suitable for use with an air pulse system.

A plurality of elongated straps 115 are utilized to secure the vest 18 to the patient. Straps 115 each include a releasable connector, such as male and female release buckles 116, 117. Female buckle 117 may be side contoured buckle. The strap end may pass through the male release buckle 116 may include a web stop formed by folding the strap end over. Adjustments of strap length may be made by pulling or releasing a strap portion through male release buckle 116. In the embodiment of FIG. 23, straps 15 generally encircle the patient, while in the embodiment of FIG. 24, straps 116 are secured proximate to the vest 18 front and do not otherwise encircle the patient. Instead forces to secure the vest to the patient are transferred directly to the vest 18 rather than indirectly via compression of the jacket by tightened straps 115 as in FIG. 23.

Figures 25, 26, 27, 28:
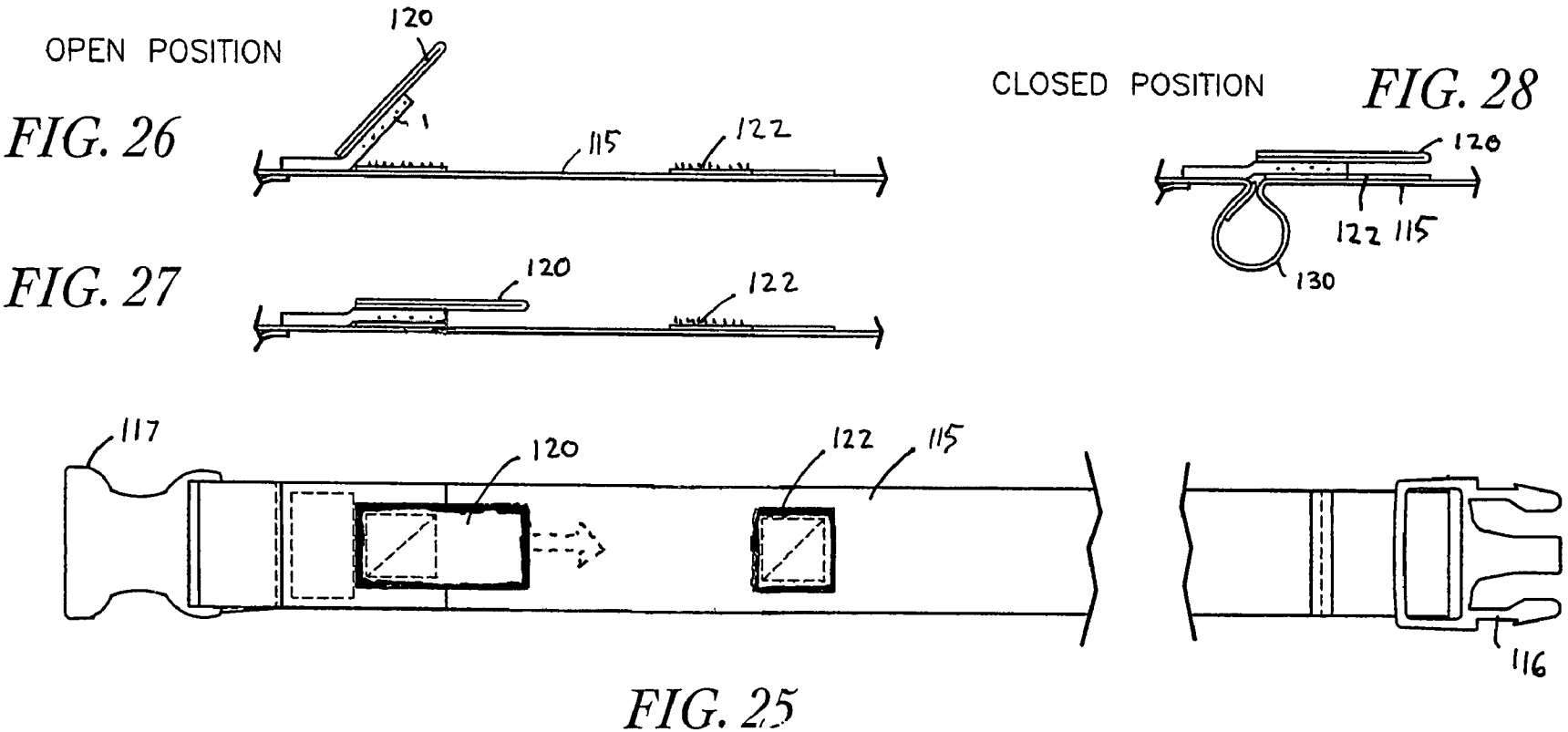
FIGS. 25-28 illustrate functional aspects of a strap sizing feature according to aspects of the present invention.

Each strap 115 includes a novel fitting device which assists in proper fitting of vest 18 to a particular patient. Referring to FIGS. 25-28, free tab ends 120 are initially positioned directly above marker 122 so that an underlying loop material can engage a corresponding hook structure. Each of the straps 115 are initially provided in this so called "Closed Position" or pre-therapy position as shown in FIG. 28. The user then dons the vest 18 and the straps 115 are secured via couplings 116, 117 so as to be lightly snug against the patient's chest.

Tabs 120 are then released and resecured into a therapy position as indicated in FIG. 27. As a result of the release, an additional length of strap 115 material (length of loop 130) is provided to the user permitting slight release of the vest from the patient and otherwise providing a desired level of snugness to the vest against the user's chest. This novel fitting device thus permits a quick approach to an optimum sizing of the vest. In the absence of such a device, either the vest is often too snug against the chest or too loose. In either case, device performance is compromised.

HFCC therapy is prescribed as either an adjunct or outright replacement for manual chest physiotherapy. Total therapy time per day varies between about 30 minutes and about 240 minutes spread over one to four treatments per day. Patients can be instructed in either the continuous intermittent mode of HFCC therapy, which may include continuous use of aerosol.

During HFCC therapy the patient sits erect, although leaning against a chair back is acceptable as long as air flow in the vest is not restricted. In the continuous mode, the patient operates the vest for 5 minutes at each of six prescribed frequencies (determined by "tuning" performed during a clinic visit). The patient uses the hand control to stop pulsing as frequently as necessary to cough, usually every several minutes.

In the intermittent mode, the patient uses the hand control to stop pulsing during inspiration to make it easier to inhale maximally. The pulsing is activated again during each expiration. Longer pauses for coughing are taken as needed. The patient goes through the cycle of prescribed frequencies determined by tuning during a clinic visit.

The vest may be "tuned" for each individual to determine the volume of air expressed from the lung and the rate of flow of this air for each chest compression frequency (e.g., from about 5 Hz to about 22 Hz). The flow rates and volume are calculated with a computer program from flow data obtained during tidal breathing through a Hans Rudolph pulmonary pneumotachometer with pinched nose. The frequencies associated with the highest flow rates are usually greater than 13 Hz, while those associated with largest volume are usually less than about 10 Hz. These best frequencies vary from patient to patient. Since the highest induced flow rates usually do not correspond with largest induced volumes, and since 2 to 3 were commonly very close in value, the three highest flow rates and the three largest volumes are selected for each patient's therapy. Occasionally one frequency is selected twice because it produces one of the three highest flow rates and one of the three largest volumes. Each of these six frequencies may be prescribed for five minutes for a total of 30 minutes each therapy session. Since the best frequencies change over time with the use of the vest, re-tuning should be performed every 3 to 6 months.

One explanation of the way in which HFCC moves mucus is derived from observations of the perturbations of air flow during tidal breathing and during maximum inspiration and exhalation to residual volume. Each chest compression produces a transient flow pulse very similar to the flow observed with spontaneous coughing. Tuning identifies those transient flows with the greatest flows and volumes, in effect the strongest coughs, and analogously with the greatest power to move mucus in the airways.

The apparatus is provided in the form of a compact air pulse delivery apparatus that is considerably smaller than those presently or previously on the market, with no single modular component of the present apparatus weighing more than about 10 pounds. Hence the total weight of the present apparatus can be on the order of 20 pounds or less, and preferably on the order of 15 pound or less, making it considerably lighter and more portable than devices presently on the market. Air flow generator module 12 is provided in the form of a conventional motor and fan assembly, and is enclosed in a compartment having air inlet and outlet ports. The air inlet port can be open to atmosphere, while the outlet port can be flowably coupled to the pulse frequency module. In another embodiment, the air flow generator module 12 may include a variable speed air fan adapted to be used with an electronic motor speed controller. In such an embodiment, the amplitude of pulses transmitted to the air vest 18 may be controlled by adjusting the fan motor speed. In embodiments of the present invention, the amplitude of the pulses may be increased or decreased in response to received physiological signals providing patient information, such as inhalation and exhalation periods, etc.

The apparatus of the present invention can provide pressurized pulses of on the order of 60 mm Hg or less. The ability to provide pulses having higher pressure, while also minimizing the overall size and weight of the unit, is a particular advantage of the present apparatus as well. Pulses of over about 60 mm Hg are generally not desirable, since they can tend to lead to bruising.

Figure 29:
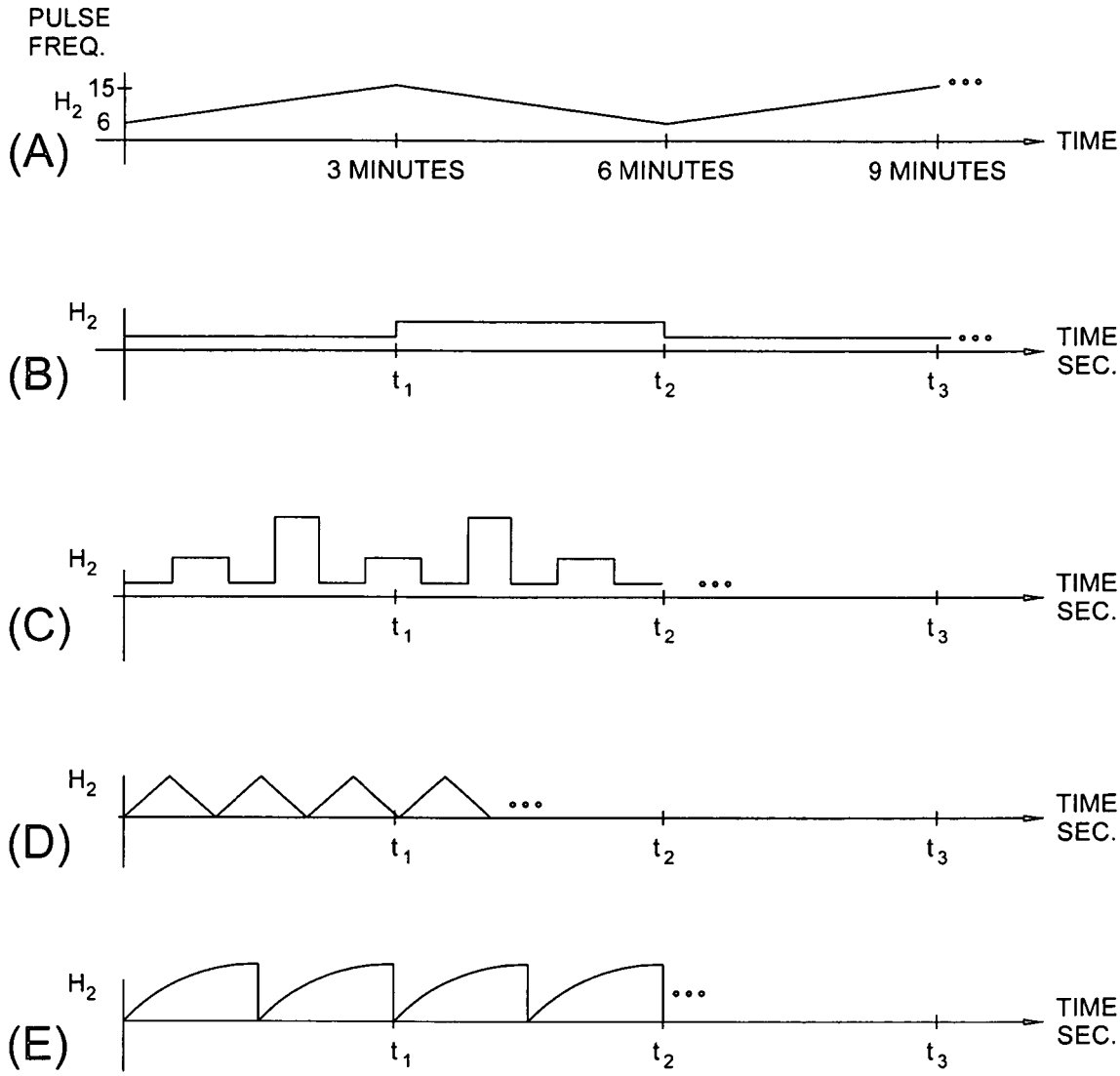
FIGS. 29-30 illustrate pulse wave forms delivered to a patient vest according to embodiments of the present invention.
Figure 30:
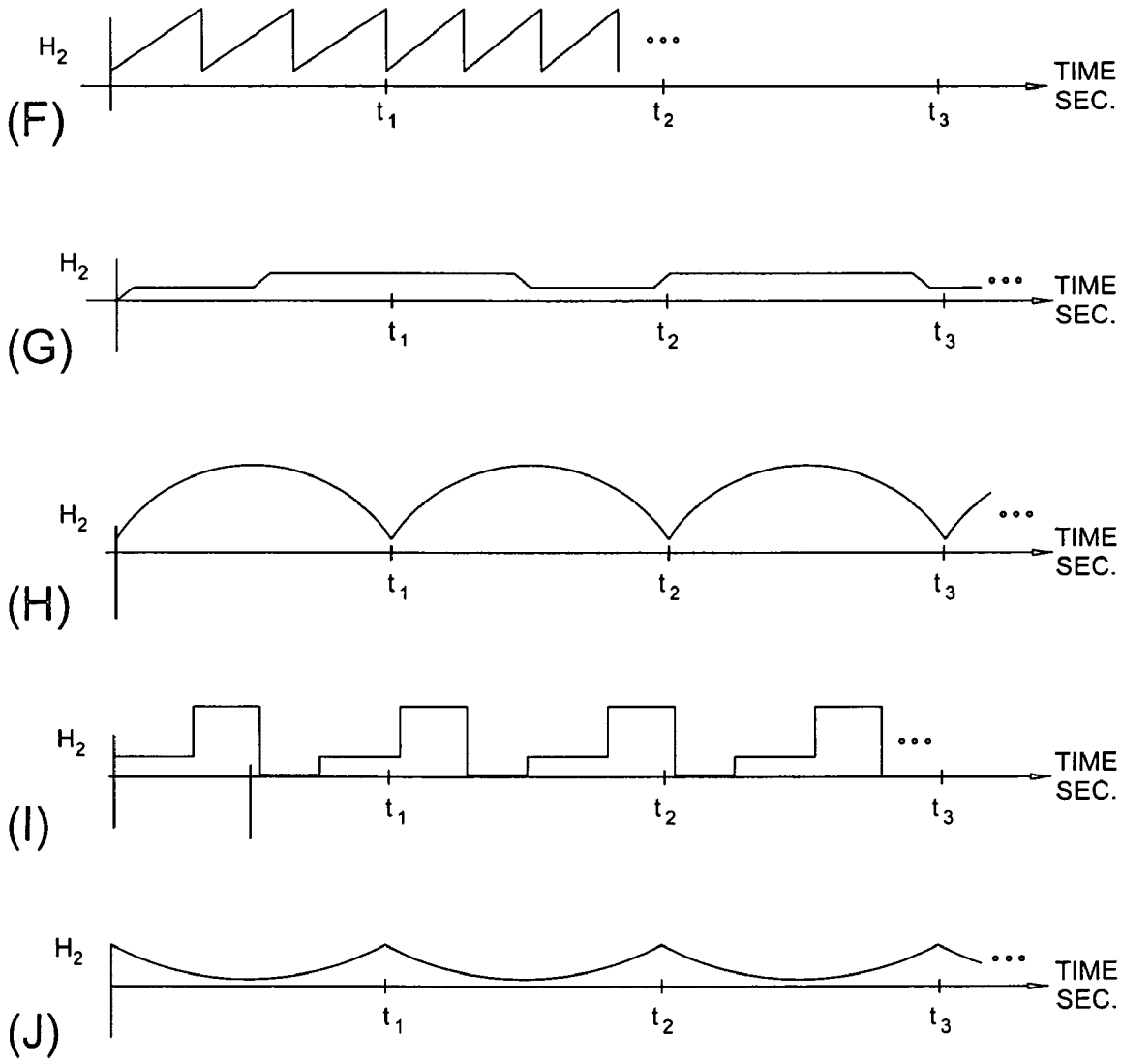

In a preferred embodiment of the present invention, the chest compression frequency can be varied over a period of time (e.g., from about 2 Hz to about 30 Hz). FIGS. 29-30 illustrate different air pressure waveforms with varying frequency to the vest 18. A ramp-type distribution of vest frequencies is illustrated in FIG. 29*a* wherein during a first period of time the vest frequency is increasing (preferably linearly) and during a second period of time the vest frequency is decreasing (preferably linearly). During device programming or by user definition, the first and second periods can be varied. Continuing with this example, during the first period of time the vest frequency varies from approximately 6 Hz to 15 Hz and during the second period of time the vest frequency varies from 15 Hz back to approximately 6 Hz. Alternative distributions may also be practicable. For example, the frequency functions may be non-linearly, e.g., parabolic, etc. In another embodiment of the present invention, the vest frequencies may increase over a period of time. As described previously, the frequency applied to the vest is dependent on the pulse frequency control module 14, and more particularly by the angular rotation of blade 20 which periodically interrupts the flow of air through the module 14. The amplitude of air pulses applied by the vest 18 to the patient may be controlled via the fan speed of air generator 12.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A chest compression apparatus providing air pulses to a user-worn air bladder comprising:

an air valve assembly having an air port in fluid communication with a pressurized air source and a vent port in fluid communication with an air vent, and a pair of bladder-side ports, said air valve assembly providing selective communication between said air vent and one of the pair of bladder-side ports and between said vent port and the other bladder-side port;

an air manifold being in fluid communication with said air port and said vent port, said air manifold receiving air pulses from said air valve assembly; and at least one air line coupled between said air manifold and said air bladder and adapted to communicate a series of said air pulses established by a flow of pressurized air from said air source and through said air valve assembly to said air manifold.

2. The chest compression apparatus of claim 1 wherein the air valve assembly comprises a rotating valve which periodically interrupts air flow between said air port and said one of the pair of bladder-side ports and said vent port and said other bladder-side port to provide a periodic pressure waveform to the air bladder.

3. The chest compression apparatus of claim 2 wherein the waveform includes one or more minor perturbations or fluctuations within the pressure waveform.

4. The chest compression apparatus of claim 2 wherein said rotating valve includes a motor-driven blade.

5. The chest compression apparatus of claim 4 wherein said blade is rotated in order to provide pulses having a substantially sinusoidal wave form.

6. The chest compression apparatus of claim 5 wherein the substantially sinusoidal wave form has a frequency selected between the range of 6 to 15 Hz.

7. The chest compression apparatus of claim 4 wherein the motor-driven blade is electronically controlled to allow for an automatic timed cycling of frequencies.

8. The chest compression apparatus of claim 4 wherein the motor-driven blade includes an offset aperture and is rotationally balanced about a center axis.

9. The chest compression apparatus of claim 1 wherein the pressurized air source includes a variable speed air fan.

10. The chest compression apparatus of claim 1 wherein the pressurized air source is in communication with an air intake plenum providing a generally decreasing cross-sectional area as said plenum approaches an inlet of said air source.

11. The chest compression apparatus of claim 10 wherein at least a portion of said at least one air line includes a flexible tubing having quick-connect air fittings with a latch to facilitate immediate connection and disconnection of said flexible tubing into said apparatus.

12. The chest compression apparatus of claim 1 wherein the air bladder is defined within a patient vest, said vest including at least one user-adjustable fitting strap having a temporary loop structure to facilitate proper fitting of said vest upon the patient.

13. The chest compression apparatus of claim 12 wherein the temporary loop structure is defined by length of strap material separated by a pair of selectively connected hook and loop fasteners.

14. A chest compression apparatus for providing a series of pressure pulses to a user-worn air bladder via a pair of air lines, said apparatus comprising:

an air valve assembly and an air manifold and providing intermittent fluid communication between one of the pair of air lines and a vent port to atmosphere resulting in a series of pressure pulses applied to the thoracic region by the air bladder, said air manifold being defined by an air chamber in fluid communication with said pair of air lines, said vent port and said air bladder, with said series of pressure pulses established by a flow of pressurized air from a source of pressurized air and through said air valve assembly to said air manifold.

15. The chest compression apparatus of claim 14 wherein the air valve assembly comprises a rotating valve which periodically interrupts air flow between the vent port and the other of the pair of air lines.

16. The chest compression apparatus of claim 15 wherein the waveform includes one or more minor perturbations or fluctuations within the pressure waveform.

17. The chest compression apparatus of claim 16 wherein the rotating valve includes a motor-driven blade.

18. The chest compression apparatus of claim 16 wherein the blade is rotated in order to provide pulses having a substantially sinusoidal wave form.

19. The chest compression apparatus of claim 18 wherein the substantially sinusoidal wave form has a frequency selected between the range of 6 to 15 Hz.

20. The chest compression apparatus of claim 19 wherein the motor-driven blade is electronically controlled to allow for an automatic timed cycling of frequencies.

21. The chest compression apparatus of claim 14 wherein the air bladder is defined within a patient vest, said vest including at least one user-adjustable fitting strap having a temporary loop structure to facilitate proper fitting of said vest upon the patient.

22. The chest compression apparatus of claim 21 wherein the temporary loop structure is defined by length of strap material separated by a pair of selectively connected hook and loop fasteners.

23. The chest compression apparatus of claim 14 wherein said pair of air lines include a flexible tubing having quick-connect air fittings with a latch to facilitate immediate connection and disconnection of said flexible tubing into said apparatus.

24. The chest compression apparatus of claim 14 wherein said source of pressurized air is in communication with an air intake plenum providing a generally decreasing cross-sectional area as said plenum approaches an inlet of said air source.

25. A chest compression apparatus for providing air pulses to a user-worn vest, said apparatus comprising:

an air valve assembly and an air manifold, with said air valve assembly and said air manifold generating series of air pulses established by a flow of pressurized air through said air valve assembly to said air manifold, said air valve assembly, said air valve and said air manifold being in fluid communication with a pair of air lines, with said air manifold bypassing at least some air between the pair of air lines, and said air valve assembly being in fluid communication with said vest to provide said series of air pulses to said vest, and a source of pressurized air in communication with said air valve and said manifold.

26. The chest compression apparatus of claim 25 wherein said source of pressurized air is in communication with an air intake plenum providing a generally decreasing cross-sectional area as said plenum approaches an inlet of said air source.

* * * * *